US011295881B2

(12) United States Patent
Natori et al.

(10) Patent No.: US 11,295,881 B2
(45) Date of Patent: Apr. 5, 2022

(54) NON-ORIENTED ELECTRICAL STEEL SHEET, MANUFACTURING METHOD OF NON-ORIENTED ELECTRICAL STEEL SHEET, AND MANUFACTURING METHOD OF MOTOR CORE

(71) Applicant: NIPPON STEEL & SUMITOMO METAL CORPORATION, Tokyo (JP)

(72) Inventors: Yoshiaki Natori, Tokyo (JP); Hiroyoshi Yashiki, Tokyo (JP); Masaru Takahashi, Tokyo (JP); Kazutoshi Takeda, Tokyo (JP); Takuya Matsumoto, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 141 days.

(21) Appl. No.: 16/312,159

(22) PCT Filed: Aug. 2, 2017

(86) PCT No.: PCT/JP2017/028144
§ 371 (c)(1),
(2) Date: Dec. 20, 2018

(87) PCT Pub. No.: WO2018/025941
PCT Pub. Date: Feb. 8, 2018

(65) Prior Publication Data

US 2019/0228891 A1 Jul. 25, 2019

(30) Foreign Application Priority Data

Aug. 5, 2016 (JP) ..... JP2016-154206

(51) Int. Cl.
*H01F 1/147* (2006.01)
*C22C 38/00* (2006.01)
(Continued)

(52) U.S. Cl.
CPC ..... *H01F 1/14783* (2013.01); *C21D 8/12* (2013.01); *C21D 8/1283* (2013.01); *C22C 38/00* (2013.01);
(Continued)

(58) Field of Classification Search
CPC ..... H01F 1/14783; C22C 38/00
(Continued)

(56) References Cited

U.S. PATENT DOCUMENTS 5,714,017 A 2/1998 Tomida et al.
5,803,988 A 9/1998 Bae et al.
(Continued)

FOREIGN PATENT DOCUMENTS

JP 7-173542 A 7/1995
JP 9-20966 A 1/1997
(Continued)

OTHER PUBLICATIONS

International Search Report for PCT/JP2017/028144 dated Nov. 7, 2017.
(Continued)

*Primary Examiner* — Weiping Zhu
(74) *Attorney, Agent, or Firm* — Birch, Stewart, Kolasch & Birch, LLP

(57) ABSTRACT

A non-oriented electrical steel sheet has a predetermined chemical composition, and when an average value of Mn concentrations in a range from a surface of a base iron to a position where a depth from the surface of the base iron is 2 μm is set to $[Mn_2]$, and an Mn concentration at a position where a depth from the surface of the base iron is 10 μm is set to $[Mn_{10}]$, the base iron satisfies the following expression 1.

$$0.1 \leq [Mn_2]/[Mn_{10}] \leq 0.9 \quad \text{(Expression 1)}$$

11 Claims, 5 Drawing Sheets

(51) Int. Cl.

| | |
|---|---|
| ***C21D 8/12*** | (2006.01) |
| ***C22C 38/60*** | (2006.01) |
| ***C22C 38/02*** | (2006.01) |
| ***C22C 38/04*** | (2006.01) |
| ***C22C 38/06*** | (2006.01) |
| ***C22C 38/14*** | (2006.01) |
| ***C22C 38/34*** | (2006.01) |
| ***C22C 38/42*** | (2006.01) |
| ***C22C 38/50*** | (2006.01) |

(52) U.S. Cl.
CPC ..... *C22C 38/001* (2013.01); *C22C 38/002* (2013.01); *C22C 38/004* (2013.01); *C22C 38/008* (2013.01); *C22C 38/02* (2013.01); *C22C 38/04* (2013.01); *C22C 38/06* (2013.01); *C22C 38/14* (2013.01); *C22C 38/34* (2013.01); *C22C 38/42* (2013.01); *C22C 38/50* (2013.01); *C22C 38/60* (2013.01); *H01F 1/147* (2013.01); *C21D 8/1222* (2013.01); *C21D 8/1233* (2013.01); *C21D 8/1272* (2013.01)

(58) Field of Classification Search
USPC ..... 148/111
See application file for complete search history.

(56) References Cited

U.S. PATENT DOCUMENTS

| | | | |
|---|---|---|---|
| 5,807,441 | A | 9/1998 | Tomida et al. |
| 2012/0009436 | A1 | 1/2012 | Arai et al. |
| 2013/0309525 | A1 | 11/2013 | Fujikura et al. |

FOREIGN PATENT DOCUMENTS

| | | | | |
|---|---|---|---|---|
| JP | 09020966 | A | * | 1/1997 |
| JP | 2700505 | B2 | | 1/1998 |
| JP | 10-183310 | A | | 7/1998 |
| JP | 2001-247944 | A | | 9/2001 |
| JP | 2002-266029 | A | | 9/2002 |
| JP | 2003-293101 | A | | 10/2003 |
| JP | 2011-168824 | A | | 9/2011 |
| JP | WO2010/104067 | A1 | | 9/2012 |
| JP | 2014-196559 | A | | 10/2014 |
| KR | 10-2013-0116332 | A | | 10/2013 |
| TW | 201038750 | A1 | | 11/2010 |
| WO | WO 93/08313 | A1 | | 4/1993 |

OTHER PUBLICATIONS

Written Opinion of the International Searching Authority for PCT/JP2017/028144 (PCT/ISA/237) dated Nov. 7, 2017.

Extended European Search Report for corresponding European Application No. 17837043.3, dated Nov. 29, 2019.

Japanese Office Action and Search Report for corresponding Japanese Application No. 2018-531963, dated Dec. 3, 2019, with English translation.

International Preliminary Report on Patentability and English translation of the Written Opinion of the International Searching Authority (forms PCT/IB/373, PCT/ISA/237 and PCT/IB/338), dated Feb. 14, 2019, for corresponding International Application No. PCT/JP2017/028144.

* cited by examiner

NON-ORIENTED ELECTRICAL STEEL SHEET, MANUFACTURING METHOD OF NON-ORIENTED ELECTRICAL STEEL SHEET, AND MANUFACTURING METHOD OF MOTOR CORE

TECHNICAL FIELD

The present invention relates to a non-oriented electrical steel sheet, a manufacturing method of a non-oriented electrical steel sheet, and a manufacturing method of a motor core.

BACKGROUND ART

In recent years, global environmental problems have been attracting attention, and demands for efforts regarding energy saving are increasing more and more. In particular, high efficiency of electric equipment has been strongly demanded in recent years. Accordingly, demands for improving magnetic properties of a non-oriented electrical steel sheet which is widely used as a material of iron core in a motor, or a transformer or the like, is further increasing. This tendency is particularly noticeable in a motor for an electric vehicle or a hybrid vehicle, and a motor for compressor in which high efficiency of motors progresses.

A motor core of various motors as described above is formed of a stator being a stationary part and a rotor being a rotary part. When manufacturing such a motor core, non-oriented electrical steel sheets are punched in a shape of the motor core and stacked, and then core annealing (strain relief annealing) is performed. The core annealing is generally carried out in an atmosphere containing nitrogen, which creates a problem such that the non-oriented electrical steel sheets are nitrided when performing the core annealing, and a core loss deteriorates.

Conventionally, various propositions have been made for the purpose of suppressing the deterioration of the core loss (Patent Literatures 1 to 3). However, according to the conventional techniques, it is difficult to sufficiently suppress the deterioration of core loss due to the nitriding of the non-oriented electrical steel sheet.

CITATION LIST

Patent Literature

Patent Literature 1: Japanese Laid-open Patent Publication No. 10-183310

Patent Literature 2: Japanese Laid-open Patent Publication No. 2003-293101

Patent Literature 3: Japanese Laid-open Patent Publication No. 2014-196559

SUMMARY OF INVENTION

Technical Problem

The present invention has an object to provide a non-oriented electrical steel sheet and a manufacturing method thereof in which a deterioration of a core loss in accordance with nitriding of the non-oriented electrical steel sheet when performing strain relief annealing is sufficiently suppressed, and a manufacturing method of a motor core using a non-oriented electrical steel sheet with a low core loss.

Solution to Problem

The present inventors conducted earnest studies for solving the above-described problems. As a result of this, it was clarified that the deterioration of the core loss due to the nitriding of the steel sheet is caused when N which is taken into the steel sheet due to the nitriding and Mn in the steel are bonded to generate a ternary precipitate of (Si,Mn)N, and this precipitate inhibits a domain wall displacement. Further, it was found out that if Mn that bonds to N does not exist when performing the strain relief annealing, the precipitation of (Si,Mn)N is suppressed, resulting in that the deterioration of the core loss can be suppressed.

The present inventors further conducted earnest studies repeatedly based on such findings, and consequently, they came up with various examples of the invention to be described below.

(1)

A non-oriented electrical steel sheet is characterized in that it includes a chemical composition represented by:

in mass %,

C: 0.0010% to 0.0050%;

Si: 2.5% to 4.0%;

Al: 0.0001% to 2.0%;

Mn: 0.1% to 3.0%;

P: 0.005% to 0.15%;

S: 0.0001% to 0.0030%;

Ti: 0.0005% to 0.0030%;

N: 0.0010% to 0.0030%;

Sn: 0.00% to 0.2%;

Sb: 0.00% to 0.2%;

Ni: 0.00% to 0.2%;

Cu: 0.00% to 0.2%;

Cr: 0.00% to 0.2%;

Ca: 0.0000% to 0.0025%;

REM: 0.0000% to 0.0050%; and the balance: Fe and impurities, in which when an average value of Mn concentrations in a range from a surface of a base iron to a position where a depth from the surface of the base iron is 2 μm is set to $[Mn_2]$, and an Mn concentration at a position where a depth from the surface of the base iron is 10 μm is set to $[Mn_{10}]$, the base iron satisfies the following expression 1.

$$0.1 \leq [Mn_2]/[Mn_{10}] \leq 0.9 \quad \text{(Expression 1)}$$

(2)

The non-oriented electrical steel sheet described in (1) is characterized in that the non-oriented electrical steel sheet contains one kind or more selected from a group consisting of:

Sn: 0.01% to 0.2%; and

Sb: 0.01% to 0.2%.

(3)

The non-oriented electrical steel sheet described in (1) or (2) is characterized in that the non-oriented electrical steel sheet contains one kind or more selected from a group consisting of:

Ni: 0.01% to 0.2%;

Cu: 0.01% to 0.2%; and

Cr: 0.01% to 0.2%.

(4)

The non-oriented electrical steel sheet described in any one of (1) to (3) is characterized in that the non-oriented electrical steel sheet contains one kind or more selected from a group consisting of:

Ca: 0.0005% to 0.0025%; and

REM: 0.0005% to 0.0050%.

(5)

The non-oriented electrical steel sheet described in any one of (1) to (4) is characterized in that:

an insulating coating film is provided to the surface of the base iron;

an adhesion amount of the insulating coating film is not less than 400 mg/m$^2$ nor more than 1200 mg/m$^2$; and a divalent Fe content and a trivalent Fe content in the insulating coating film are not less than 10 mg/m$^2$ nor more than 250 mg/m$^2$ in total.

A manufacturing method of a non-oriented electrical steel sheet is characterized in that it includes:

performing hot rolling of a steel ingot to obtain a hot-rolled steel sheet;

performing hot-rolled sheet annealing of the hot-rolled steel sheet;

performing pickling after the hot-rolled sheet annealing;

performing cold rolling after the pickling to obtain a cold-rolled steel sheet; and performing finish annealing of the cold-rolled steel sheet, in which:

the hot-rolled sheet annealing is performed by setting a dew point to not less than −40° C. nor more than 60° C., setting an annealing temperature to not less than 900° C. nor more than 1100° C., and setting a soaking time to not less than 1 second nor more than 300 seconds, while leaving a scale generated during the hot rolling;

when an average value of Mn concentrations in a range from a surface of a base iron to a position where a depth from the surface of the base iron is 5 μm is set to [$Mn_5$], and an Mn concentration at a position where a depth from the surface of the base iron is 10 μm is set to [$Mn_{10}$], the pickling is performed so that the base iron after the pickling satisfies the following expression 2;

an annealing temperature is set to less than 900° C. in the finish annealing; and the steel ingot has a chemical composition represented by:

in mass %,

C: 0.0010% to 0.0050%;

Si: 2.5% to 4.0%;

Al: 0.0001% to 2.0%;

Mn: 0.1% to 3.0%;

P: 0.005% to 0.15%;

S: 0.0001% to 0.0030%;

Ti: 0.0005% to 0.0030%;

N: 0.0010% to 0.0030%;

Sn: 0.00% to 0.2%;

Sb: 0.00% to 0.2%;

Ni: 0.00% to 0.2%;

Cu: 0.00% to 0.2%;

Cr: 0.00% to 0.2%;

Ca: 0.0000% to 0.0025%;

REM: 0.0000% to 0.0050%; and the balance: Fe and impurities.

$$0.1 \leq [Mn_5]/[Mn_{10}] \leq 0.9 \quad \text{(Expression 2)}$$

(7)

The manufacturing method of the non-oriented electrical steel sheet described in (6) is characterized in that it further includes, after the finish annealing, forming an insulating coating film on the surface of the base iron.

(8)

The manufacturing method of the non-oriented electrical steel sheet described in (6) or (7) is characterized in that the steel ingot contains one kind or more selected from a group consisting of:

Sn: 0.01% to 0.2%; and

Sb: 0.01% to 0.2%.

(9)

The manufacturing method of the non-oriented electrical steel sheet described in any one of (6) to (8) is characterized in that the steel ingot contains one kind or more selected from a group consisting of:

Ni: 0.01% to 0.2%;

Cu: 0.01% to 0.2%; and

Cr: 0.01% to 0.2%.

(10)

The manufacturing method of the non-oriented electrical steel sheet described in any one of (6) to (9) is characterized in that the steel ingot contains one kind or more selected from a group consisting of:

Ca: 0.0005% to 0.0025%; and

REM: 0.0005% to 0.0050%.

(11)

A manufacturing method of a motor core is characterized in that it includes:

punching non-oriented electrical steel sheets in a core shape;

stacking the punched non-oriented electrical steel sheets; and performing strain relief annealing of the stacked non-oriented electrical steel sheets, in which:

in the strain relief annealing, a proportion of nitrogen in an annealing atmosphere is set to 70 volume % or more, and a strain relief annealing temperature is set to not less than 750° C. nor more than 900° C.;

the non-oriented electrical steel sheet has a chemical composition represented by:

in mass %,

C: 0.0010% to 0.0050%;

Si: 2.5% to 4.0%;

Al: 0.0001% to 2.0%;

Mn: 0.1% to 3.0%;

P: 0.005% to 0.15%;

S: 0.0001% to 0.0030%;

Ti: 0.0005% to 0.0030%;

N: 0.0010% to 0.0030%;

Sn: 0.00% to 0.2%;

Sb: 0.00% to 0.2%;

Ni: 0.00% to 0.2%;

Cu: 0.00% to 0.2%;

Cr: 0.00% to 0.2%;

Ca: 0.0000% to 0.0025%;

REM: 0.0000% to 0.0050%; and the balance: Fe and impurities; and when an average value of Mn concentrations in a range from a surface of a base iron to a position where a depth from the surface of the base iron is 2 μm is set to [$Mn_2$], and an Mn concentration at a position where a depth from the surface of the base iron is 10 μm is set to [$Mn_{10}$], the following expression 1 is satisfied.

$$0.1 \leq [Mn_2]/[Mn_{10}] \leq 0.9 \quad \text{(Expression 1)}$$

(12)

The manufacturing method of the motor core described in (11) is characterized in that an insulating coating film is provided to the surface of the base iron.

(13)

The manufacturing method of the motor core described in (11) or (12) is characterized in that the non-oriented electrical steel sheet contains one kind or more selected from a group consisting of:

Sn: 0.01% to 0.2%; and

Sb: 0.01% to 0.2%.

(14)

The manufacturing method of the motor core described in any one of (11) to (13) is characterized in that the non-oriented electrical steel sheet contains one kind or more selected from a group consisting of:

Ni: 0.01% to 0.2%;

Cu: 0.01% to 0.2%; and

Cr: 0.01% to 0.2%.

(15)

The manufacturing method of the motor core described in any one of (11) to (14) is characterized in that the non-oriented electrical steel sheet contains one kind or more selected from a group consisting of:

Ca: 0.0005% to 0.0025%; and

REM: 0.0005% to 0.0050%.

Advantageous Effects of Invention

According to the present invention, an Mn concentration inside a base iron is appropriate, so that it is possible to sufficiently suppress a deterioration of a core loss in accordance with nitriding of a non-oriented electrical steel sheet when performing strain relief annealing.

DESCRIPTION OF EMBODIMENTS

Figure 1:
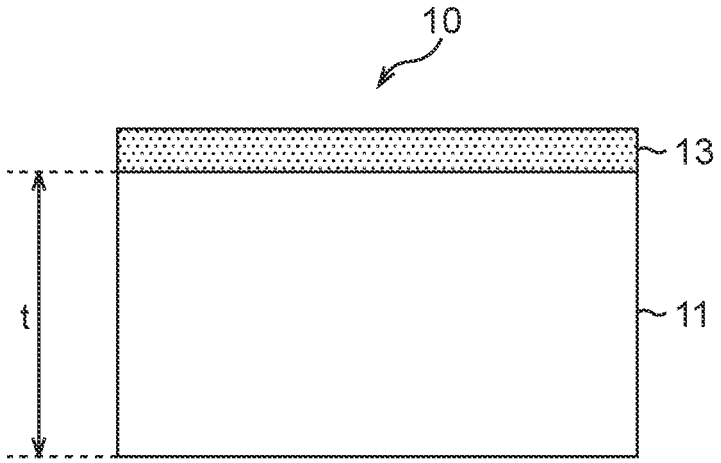
FIG. 1 is a sectional view illustrating a non-oriented electrical steel sheet according to an embodiment of the present invention.

First, a chemical composition of a non-oriented electrical steel sheet according to an embodiment of the present invention and a steel ingot used for manufacturing the non-oriented electrical steel sheet will be described. Although details will be described later, the non-oriented electrical steel sheet according to the embodiment of the present invention is manufactured through hot rolling of a steel ingot, hot-rolled sheet annealing, pickling, cold rolling, and finish annealing and the like. Therefore, the chemical composition of the non-oriented electrical steel sheet and the steel ingot takes not only properties of the non-oriented electrical steel sheet but also these treatments into consideration. In the following description, being a unit of content of each element contained in the non-oriented electrical steel sheet means "mass %" unless otherwise mentioned. The non-oriented electrical steel sheet according to the present embodiment has a chemical composition represented by: C: 0.0010% to 0.0050%; Si: 2.5% to 4.0%; Al: 0.0001% to 2.0%; Mn: 0.1% to 3.0%; P: 0.005% to 0.15%; S: 0.0001% to 0.0030%; Ti: 0.0005% to 0.0030%; N: 0.0010% to 0.0030%; Sn: 0.00% to 0.2%; Sb: 0.00% to 0.2%; Ni: 0.00% to 0.2%; Cu: 0.00% to 0.2%; Cr: 0.00% to 0.2%; Ca: 0.0000% to 0.0025%; REM: 0.0000% to 0.0050%; and the balance: Fe and impurities. Examples of the impurities are those contained in a raw material such as an ore or scrap, and those contained during manufacturing processes.

(C: 0.0010% to 0.0050%)

C causes a deterioration of a core loss. If a C content exceeds 0.0050%, the core loss deteriorates in a steel sheet, and good magnetic properties cannot be obtained. Therefore, the C content is set to 0.0050% or less, preferably set to 0.0040% or less, and more preferably set to 0.0030% or less. On the other hand, if the C content is less than 0.0010%, a magnetic flux density is lowered in the steel sheet, and it is not possible to obtain the good magnetic properties. Therefore, the C content is set to 0.0010% or more, and preferably set to 0.0015% or more.

(Si: 2.5% to 4.0%)

Si increases an electrical resistance of steel to reduce an eddy current loss, thereby improving a high-frequency core loss. Further, Si improves a strength of the steel sheet through solid-solution strengthening. If an Si content is less than 2.5%, an effect brought by this operation cannot be sufficiently achieved. Therefore, the Si content is set to 2.5% or more, preferably set to 2.7% or more, and more preferably set to 3.0% or more. On the other hand, if the Si content exceeds 4.0%, workability significantly deteriorates, and it becomes difficult to perform cold rolling. Therefore, the Si content is set to 4.0% or less, preferably set to 3.7% or less, and more preferably set to 3.5% or less.

(Al: 0.0001% to 2.0%)

Al increases the electrical resistance of the steel sheet to reduce the eddy current loss, thereby improving the high-frequency core loss. On the other hand, Al reduces the workability in the process of manufacturing the steel sheet and the magnetic flux density of a product, so that from this viewpoint, it is preferable that a small amount of Al is contained. If the Al content is less than 0.0001%, a load in a steel-making process is high, and a cost is increased. Therefore, the Al content is set to 0.0001% or more, preferably set to 0.0010% or more, and more preferably set to 0.0100% or more. On the other hand, if the Al content exceeds 2.0%, the magnetic flux density of the steel sheet is significantly lowered or embrittlement is caused, which makes it difficult to perform the cold rolling. Therefore, the Al content is set to 2.0% or less, preferably set to 1.0% or less, and more preferably set to 0.7% or less.

(Mn: 0.1% to 3.0%)

Mn increases the electrical resistance of steel to reduce the eddy current loss, thereby improving the high-frequency core loss. If an Mn content is less than 0.1%, an effect brought by this operation cannot be sufficiently achieved. Therefore, the Mn content is set to 0.1% or more, preferably set to 0.3% or more, and more preferably set to 0.5% or more. On the other hand, if the Mn content exceeds 3.0%, the magnetic flux density is significantly lowered. Therefore, the Mn content is set to 3.0% or less, preferably set to 2.0% or less, and more preferably set to 1.3% or less.

(P: 0.005% to 0.15%)

P has a large solid-solution strengthening property and increases a {100} texture which is advantageous for improving the magnetic properties, and thus P realizes both of a high strength and a high magnetic flux density. Besides, the increase in the {100} texture also contributes to the reduction in the anisotropy of the mechanical properties within a sheet surface of the non-oriented electrical steel sheet, so that P improves a dimensional accuracy at a time of performing punching of the non-oriented electrical steel sheet. If a P content is less than 0.005%, an effect brought by this operation cannot be sufficiently achieved. Therefore, the P content is set to 0.005% or more, preferably set to 0.01% or more, and more preferably set to 0.04% or more. On the other hand, if the P content exceeds 0.15%, ductility of the non-oriented electrical steel sheet is significantly lowered. Therefore, the P content is set to 0.15% or less, preferably set to 0.10% or less, and more preferably set to 0.08% or less.

(S: 0.0001% to 0.0030%)

S forms a fine precipitate of MnS to increase the core loss, thereby making the magnetic properties of the non-oriented electrical steel sheet deteriorate. Therefore, an S content is set to 0.0030% or less, preferably set to 0.0020% or less, and more preferably set to 0.0010% or less. On the other hand, if the S content is less than 0.0001%, a cost is increased. Therefore, the S content is set to 0.0001% or more, and preferably set to 0.0003% or more. From a viewpoint of suppressing the increase in the N concentration caused by the nitriding, the S content is more preferably set to 0.0005% or more.

(N: 0.0010% to 0.0030%)

N causes magnetic aging to increase the core loss, thereby making the magnetic properties of the non-oriented electrical steel sheet deteriorate. Therefore, an N content is set to 0.0030% or less, preferably set to 0.0025% or less, and more preferably set to 0.0020% or less. On the other hand, if the N content is less than 0.0010%, a cost is increased. Therefore, the N content is set to 0.0010% or more, and preferably set to 0.0015% or more.

(Ti: 0.0005% to 0.0030%)

Ti bonds to C, N, Mn, and the like to form inclusions, and inhibits growth of crystal grains during the strain relief annealing to make the magnetic properties deteriorate. Therefore, a Ti content is set to 0.0030% or less, preferably set to 0.0015% or less, and more preferably set to 0.0010% or less. On the other hand, if the Ti content is less than 0.0005%, a cost is increased. Therefore, the Ti content is set to 0.0005% or more, and preferably set to 0.0006% or more.

(One Kind or More Selected from Group Consisting of Sn: 0.00% to 0.2% and Sb: 0.00% to 0.2%)

Sn and Sb segregate in a surface of the steel sheet to suppress oxidation during the annealing, to thereby secure a low core loss. Therefore, Sn or Sb may be contained. If a content of each of one kind or more selected from a group consisting of Sn and Sb is less than 0.01%, an effect brought by this operation sometimes cannot be sufficiently achieved. Therefore, the content of each of one kind or more selected from the group consisting of Sn and Sb is preferably set to 0.01% or more, and more preferably set to 0.03% or more. On the other hand, if the content of each of one kind or more selected from the group consisting of Sn and Sb exceeds 0.2%, the ductility of the base iron is lowered and it becomes difficult to perform the cold rolling. Therefore, the content of each of one kind or more selected from the group consisting of Sn and Sb is set to 0.2% or less, and preferably set to 0.1% or less.

(One Kind or More Selected from Group Consisting of Ni: 0.00% to 0.2%, Cu: 0.00% to 0.2%, and Cr: 0.00% to 0.2%)

Ni, Cu, and Cr increase a specific resistance to reduce the core loss. Therefore, Ni, Cu, or Cr may be contained. If a content of each of one kind or more selected from a group consisting of Ni, Cu, and Cr is less than 0.01%, an effect brought by this operation sometimes cannot be sufficiently achieved. Therefore, the content of each of one kind or more selected from the group consisting of Ni, Cu, and Cr is preferably set to 0.01% or more, and more preferably set to 0.03% or more. On the other hand, if the content of each of one kind or more selected from the group consisting of Ni, Cu, and Cr exceeds 0.2%, the magnetic flux density deteriorates. Therefore, the content of each of one kind or more selected from the group consisting of Ni, Cu, and Cr is set to 0.2% or less, and preferably set to 0.1% or less.

(One Kind or More Selected from Group Consisting of Ca: 0.0000% to 0.0025% and REM: 0.0000% to 0.0050%)

Ca and REM (rare earth metal) facilitate the growth of crystal grains when performing the finish annealing. Therefore, Ca or REM may be contained. If a content of each of one kind or more selected from a group consisting of Ca and REM is less than 0.0005%, an effect brought by this operation sometimes cannot be sufficiently achieved. Therefore, the content of each of one kind or more selected from the group consisting of Ca and REM is preferably set to 0.0005% or more, and more preferably set to 0.0010% or more. On the other hand, if the Ca content exceeds 0.0025%, the aforementioned effect is saturated and a cost is increased. Therefore, the Ca content is set to 0.0025% or less. If the REM content exceeds 0.0050%, the aforementioned effect is saturated and a cost is increased. Therefore, the REM content is set to 0.0050% or less, and preferably set to 0.0030% or less.

(Others)

The non-oriented electrical steel sheet according to the present embodiment may also further contain Pb, Bi, V, As, B, and so on in an amount of 0.0001% to 0.0050%, respectively.

Note that when measuring the chemical composition of the non-oriented electrical steel sheet according to the present embodiment and the steel ingot used for manufacturing the non-oriented electrical steel sheet in an ex-post manner, it is possible to use publicly-known various measurement methods. For example, an ICP-MS (inductively coupled plasma mass spectrometry) method or the like may be appropriately used.

Next, the non-oriented electrical steel sheet according to the embodiment of the present invention will be described while referring to FIG. 1. FIG. 1 is a sectional view illustrating the non-oriented electrical steel sheet according to the embodiment of the present invention. A non-oriented electrical steel sheet 10 according to the present embodiment includes a base iron 11 having the above-described predetermined chemical composition. If a sheet thickness t of the base iron 11 exceeds 0.35 mm, it is sometimes not possible to reduce the high-frequency core loss. Therefore, the sheet thickness t of the base iron 11 is preferably set to 0.35 mm or less, and more preferably set to 0.31 mm or less. On the other hand, if the sheet thickness t of the base iron 11 is less than 0.10 mm, there is a possibility that it becomes difficult to pass the sheet in an annealing line due to the small sheet thickness. Therefore, the sheet thickness t of the base iron 11 is preferably set to 0.10 mm or more, and more preferably set to 0.19 mm or more.

It is also possible that an insulating coating film 13 is provided to a surface of the base iron 11. Since core blanks are punched from the non-oriented electrical steel sheets 10 and then stacked to be used, by providing the insulating coating film 13 to the surface of the base iron 11, it is possible to reduce an eddy current between the steel sheets, and it becomes possible to reduce the eddy current loss as a core.

The insulating coating film 13 is not particularly limited as long as it is used as an insulating coating film of the non-oriented electrical steel sheet, and it is possible to use a publicly-known insulating coating film. As such an insulating coating film, for example, there can be cited a composite insulating coating film containing an inorganic substance as a main component and further containing an organic substance. The composite insulating coating film is, for example, an insulating coating film containing metal chromate, metal phosphate, or at least any of an inorganic substance of colloidal silica, a Zr compound, a Ti compound, and the like as a main component, and in which fine organic resin particles are dispersed. In particular, from a viewpoint of reducing an environmental load at a time of manufacture, which has been further demanded in recent years, there is used an insulating coating film which uses a coupling agent of metal phosphate, Zr, or Ti, or a carbonate or an ammonium salt thereof as a starting material.

An adhesion amount of the insulating coating film 13 is not particularly limited, but, it is preferably set to not less than 400 mg/m$^2$ nor more than 1200 mg/m$^2$ per one side, for example. When the insulating coating film 13 with such an adhesion amount is provided to the surface of the base iron 11, it becomes possible to maintain excellent uniformity. If the adhesion amount of the insulating coating film 13 is less than 400 mg/m$^2$ per one side, it becomes difficult to maintain the excellent uniformity. Therefore, the adhesion amount of the insulating coating film 13 is preferably set to 400 mg/m$^2$ or more per one side, and more preferably set to 800 mg/m$^2$ or more per one side. On the other hand, if the adhesion amount of the insulating coating film 13 exceeds 1200 mg/m$^2$, a baking time longer than a normal baking time of an insulating coating film is required, so that a cost is increased. Therefore, the adhesion amount of the insulating coating film 13 is preferably set to 1200 mg/m$^2$ or less per one side, and more preferably set to 1000 mg/m$^2$ or less per one side. Note that when the adhesion amount of the insulating coating film 13 is measured in an ex-post manner, it is possible to use publicly-known various measurement methods, and, for example, a method of measuring a mass difference between before and after immersion into a sodium hydroxide aqueous solution, a fluorescent X-ray method using a calibration curve method, or the like may be appropriately used.

A divalent Fe content and a trivalent Fe content in the insulating coating film 13 are preferably set to not less than 10 mg/m$^2$ nor more than 250 mg/m$^2$ in terms of metal Fe. If the divalent Fe content and the trivalent Fe content are less than 10 mg/m$^2$, it is not possible to sufficiently suppress permeation of oxygen and the like which inevitably exist in an atmosphere at a time of the strain relief annealing which is carried out when manufacturing a motor core, resulting in that it becomes difficult to improve adhesiveness of the insulating coating film 13, and it also becomes difficult to increase the annealing temperature in the strain relief annealing. Therefore, the divalent Fe content and the trivalent Fe content are preferably set to 10 mg/m$^2$ or more, and more preferably set to 50 mg/m$^2$ or more. On the other hand, if the divalent Fe content and the trivalent Fe content exceed 250 mg/m$^2$, a baking time longer than a normal baking time of an insulating coating film is required, so that a cost is increased. Therefore, the divalent Fe content and the trivalent Fe content are preferably set to 250 mg/m$^2$ or less, and more preferably set to 200 mg/m$^2$ or less. As a factor for improving the adhesiveness between the base iron 11 and the insulating coating film 13, there can be considered the existence of a demanganization layer to be described later. When compared to Al or Si, Mn is likely to be oxidized in the vicinity of the surface of the base iron 11 where a larger amount of oxygen exists, and Mn is unlikely to be oxidized inside the base iron 11. For this reason, an external oxide film in which Mn is concentrated, is likely to be formed on an uppermost surface layer of the base iron 11. However, because of the existence of the demanganization layer, the external oxide film being the Mn-concentrated layer is unlikely to be formed, so that a surface area where a treatment solution of the insulating coating film 13 and the base iron 11 are reacted increases, resulting in that the divalent Fe content and the trivalent Fe content in the insulating coating film 13 increase. When the divalent Fe content and the trivalent Fe content in the insulating coating film 13 are increased, Fe ions and oxygen are bonded before oxygen and the like which inevitably exist in the atmosphere reach the base iron 11, and thus it is possible to suppress the permeation of oxygen and the like into the steel sheet itself. The oxygen reached an interface between the insulating coating film 13 and the base iron 11 bonds to Si or Al in the steel to form an oxide film. When a foreign substance such as this oxide film is generated at the interface between the insulating coating film 13 and the base iron 11, the adhesiveness between the base iron 11 and the insulating coating film 13 deteriorates. For this reason, it can be considered that because of the suppression of permeation of oxygen and the like, the adhesiveness between the base iron 11 and the insulating coating film 13 is improved. It can be considered that, according to such a mechanism, the existence of the demanganization layer contributes to the improvement of adhesiveness between the base iron 11 and the insulating coating film 13.

Next, a depth direction distribution of Mn in the base iron of the non-oriented electrical steel sheet according to the embodiment of the present invention will be described. As described above, the strain relief annealing is often performed in nitrogen as a non-oxidizing atmosphere. However, when performing the strain relief annealing, the core loss deteriorates due to the progress of nitriding of the base iron and the precipitation of (Si,Mn)N according to the nitriding. If argon or helium, instead of nitrogen, is used as the inert atmosphere, the nitriding is suppressed, but, a cost is required. Therefore, it is industrially unavoidable to use nitrogen as a main atmosphere at the time of performing the strain relief annealing. Accordingly, the present inventors obtained a finding such that if Mn to which N bonds does not exist, the precipitation of (Si,Mn)N can be suppressed, and it is possible to suppress the deterioration of the core loss.

The increase in the N concentration due to the nitriding is limited to the vicinity of the surface of the base iron. For this reason, if the Mn concentration in the vicinity of the surface of the base iron where solid-solution of N occurs can be reduced, it is possible to suppress the precipitation of (Si,Mn)N. Further, if the content of Mn having a high affinity to N and existing in the uppermost surface of the base iron can be reduced, it also becomes possible to suppress a reaction itself such that $N_2$ molecules are decomposed and dissolved in the base iron as N atoms. Besides, it becomes possible to prevent the entrance of N into the steel also when a solubility of MnS is increased to increase the solid-solution S. Based on these, the present inventors found out that by making the distribution of Mn to be unevenly distributed in the vicinity of the surface of the base iron, it is possible to obtain the good magnetic properties by suppressing the deterioration of the core loss when performing the strain relief annealing.

Figure 2:
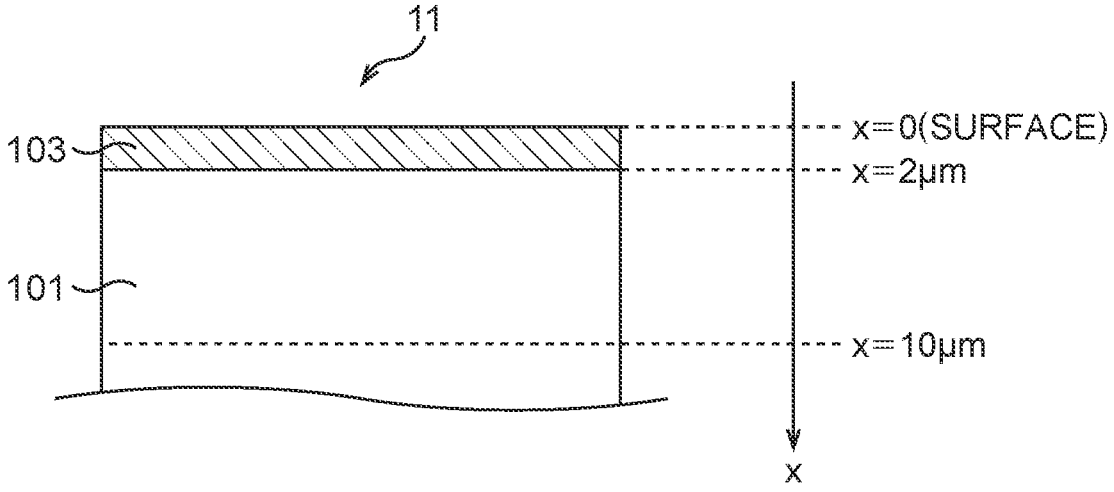
FIG. 2 is a schematic view illustrating a vicinity of a surface of a base iron in the non-oriented electrical steel sheet according to the embodiment of the present invention.

FIG. 2 is a schematic view illustrating the vicinity of the surface of the base iron in the non-oriented electrical steel sheet according to the embodiment of the present invention. Note that in FIG. 2, an x-axis positive direction is set in a direction heading from the surface of the base iron 11 to a center in a thickness direction (depth direction), and explanation will be made in the present specification by using this coordinate axis, as a matter of convenience.

The base iron 11 includes a base material part 101 and a demanganization layer 103. The base material part 101 is a part containing Mn which is distributed in a nearly uniform manner inside the base iron 11, and the Mn concentration of the base material part 101 has a value which is nearly equal to a value of the Mn content of the base iron 11. The demanganization layer 103 is a layer positioned on a surface side of the base iron 11, and the Mn concentration of the demanganization layer 103 has a value which is relatively lower than a value of the Mn concentration of the base material part 101.

Concretely, when the surface of the base iron 11 is set to an origin of the x axis (specifically, position of x=0 μm), the demanganization layer 103 satisfies a relation of the following expression (1). Specifically, when an average value of Mn concentrations in a range from the surface of the base iron 11 to a position where a depth from the surface of the base iron 11 is 2 μm is set to $[Mn_2]$, and an Mn concentration at a position where a depth from the surface of the base iron 11 is 10 μm is set to $[Mn_{10}]$, the base iron 11 satisfies the following expression 1. When the relation of the following expression 1 is satisfied, in the non-oriented electrical steel sheet according to the present embodiment, it becomes possible to obtain the good magnetic properties by suppressing the deterioration of the core loss when performing the strain relief annealing.

$$0.1 \leq [Mn_2]/[Mn_{10}] \leq 0.9 \quad \text{(Expression 1)}$$

Figure 3:
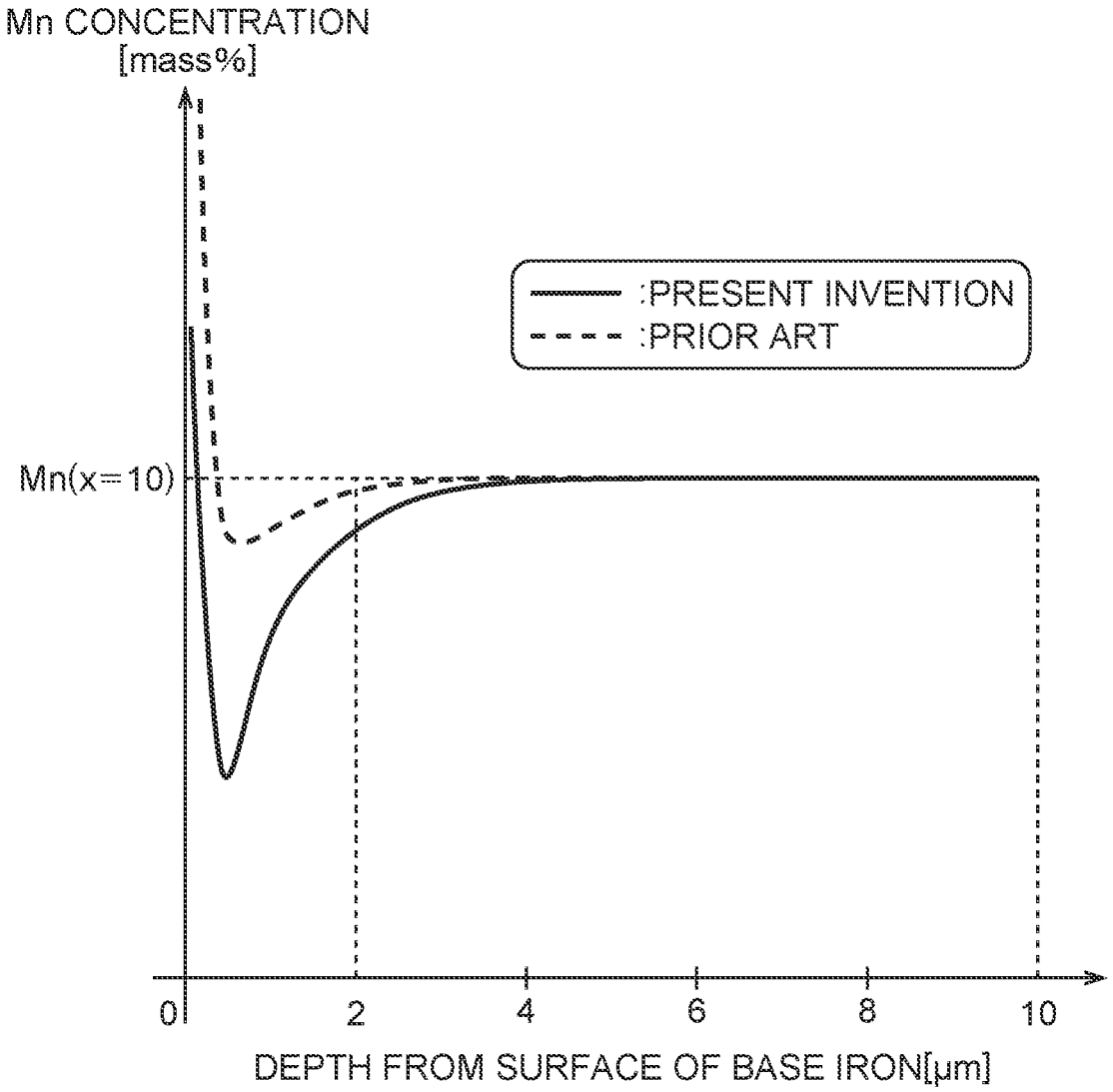
FIG. 3 is a schematic view illustrating a distribution of Mn concentration in a base iron.

FIG. 3 is a schematic view illustrating a distribution of Mn concentration in the base iron. From FIG. 3, when the demanganization layer does not exist in the base iron, and the distribution of Mn in the depth direction (x direction) is uniform, the Mn concentration should be nearly constant at the value of $[Mn_{10}]$ (in other words, a value of an average Mn concentration in the entire base iron 11). Further, even in a case where the technique of forming the Al-concentrated layer as in the aforementioned Patent Literature 1 is applied, it can be considered that the Mn concentration in the vicinity of the surface of the base iron becomes higher than the value of the average Mn concentration in the entire base iron, as indicated by a dotted line in FIG. 3. However, in the base iron in the non-oriented electrical steel sheet according to the present embodiment, the Mn concentration in the vicinity of the surface of the base iron becomes lower than the value of the average Mn concentration in the entire base iron.

Specifically, in the base iron in the non-oriented electrical steel sheet according to the present embodiment, the demanganization layer is provided, so that the average value of Mn concentrations in the range from the surface of the base iron (x=0 μm) to the position where the depth is 2 μm (x=2 μm) ($[Mn_2]$) is lower than the Mn concentration at the position where the depth is 10 μm (x=10 μm) ($[Mn_{10}]$), as illustrated in FIG. 3. Therefore, as indicated by an inequality of the rightmost side of the aforementioned expression 1, a concentration ratio represented by $[Mn_2]/[Mn_{10}]$ is set to 0.9 or less, preferably set to 0.8 or less, and more preferably set to 0.7 or less. This means that the Mn concentration of the demanganization layer is relatively lower than the average Mn concentration of the base material part. In such a demanganization layer, an amount of Mn which is excessively dissolved with respect to S is small, so that when S is solid-dissolved to be dispersed, entropy is larger when compared to a case where S is fixed as MnS, and thus a stabilized state is created. For this reason, it can be considered that when the solubility of MnS is increased, the solid-solution S is increased. Therefore, when the solubility of MnS is increased to increase the solid-solution S, it becomes possible to reduce the S amount which has been difficult to be realized because of concerns that the N concentration is increased due to the nitriding, and it is possible to further suppress the deterioration of the core loss because of the improvement of grain growth property after the heat treatment in particular. It can be considered that if there exists the solid-solution S which is likely to segregate in the crystal grain boundary, a path through which N enters into the steel is blocked, so that the nitriding is unlikely to occur. Normally, if the S amount is reduced, the solid-solution S is reduced, and the N concentration is increased due to the nitriding. However, in the present embodiment, even if the S amount is reduced, S exists in a state of solid-solution S without being fixed as MnS, and thus the nitriding can be suppressed. Further, when the solubility of MnS is increased to increase the solid-solution S, it is possible to reduce the contents of Sn and Sb which have been conventionally required for reducing the S amount, resulting in that the manufacture can be realized in an inexpensive manner. Besides, since the solubility of MnS is increased to increase the solid-solution S, the solid-solution S can suppress the permeation of not only nitrogen but also oxygen, and thus it is possible to improve the adhesiveness between the insulating coating film and the base iron after the heat treatment.

On the other hand, when the Mn concentration of the demanganization layer is excessively lowered, and the concentration ratio represented by $[Mn_2]/[Mn_{10}]$ becomes less than 0.1, the Mn content in the vicinity of the surface of the base iron is excessively lowered, and the high-frequency core loss deteriorates. Therefore, as indicated by an inequality of the leftmost side of the aforementioned expression 1, the concentration ratio represented by $[Mn_2]/[Mn_{10}]$ is set to 0.1 or more, preferably set to 0.2 or more, and more preferably set to 0.5 or more.

The Mn concentration of the base iron along the depth direction from the surface of the base iron can be specified by using a glow discharge spectroscopy (GDS). Regarding measurement conditions of the GDS, although there are prepared a direct current mode, a high-frequency mode, and in addition to that, a pulse mode and the like in accordance with a material to be analyzed, in the present embodiment which mainly analyzes the base iron being a conductor, there is no large difference even if the measurement is performed by any of the modes. For this reason, a measuring time at which sputtering marks become uniform and the analysis can be performed with respect to the depth of 10 μm or more is set as a condition, and the analysis may be performed appropriately.

The non-oriented electrical steel sheet according to the present embodiment includes the configuration as described above, thereby exhibiting the excellent magnetic properties. Various magnetic properties which are exhibited by the non-oriented electrical steel sheet according to the present embodiment can be measured based on the Epstein method specified in JIS C2550, a single sheet tester (SST) specified in JIS C2556, or the like.

Figure 4:
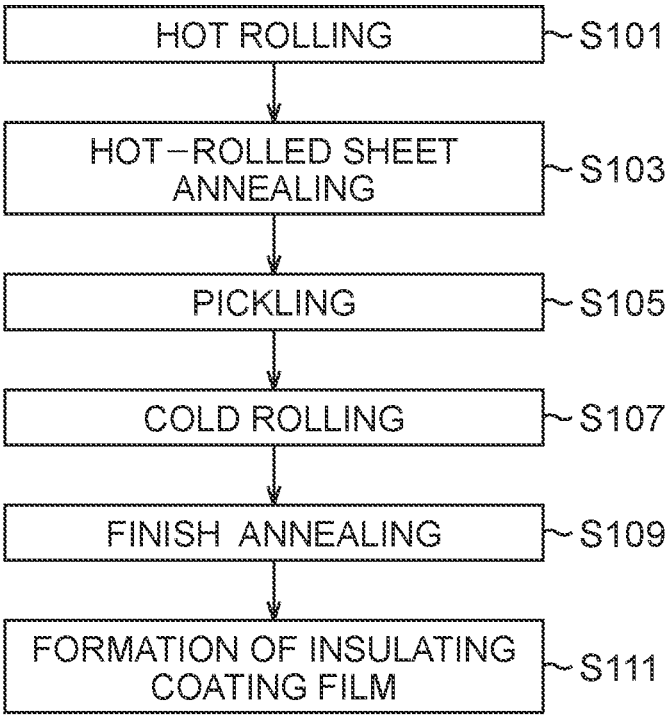
FIG. 4 is a flow chart illustrating one example of a manufacturing method of the non-oriented electrical steel sheet according to the embodiment of the present invention.
Figure 5:
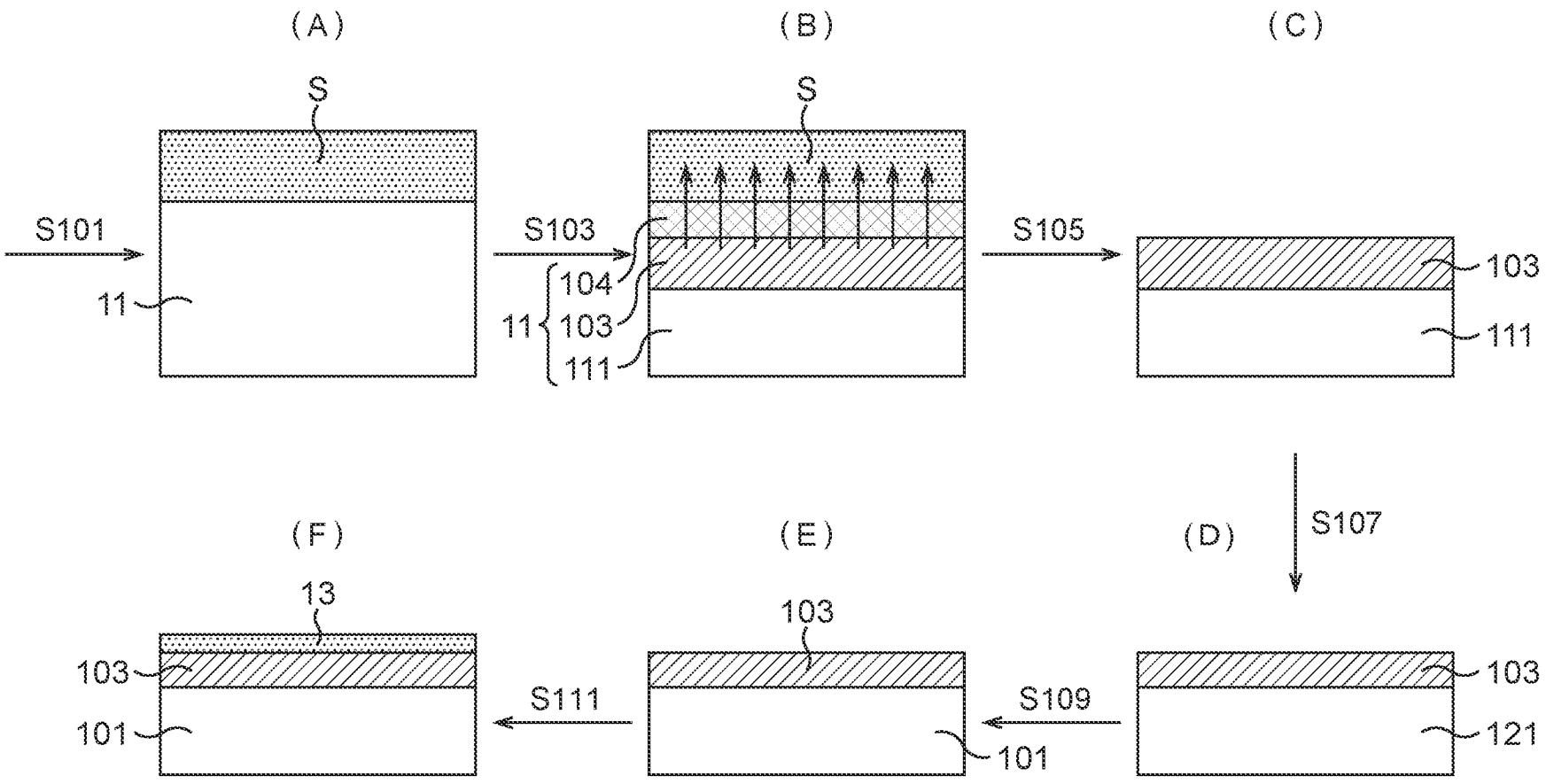
FIG. 5 are schematic views for explaining the manufacturing method of the non-oriented electrical steel sheet according to the embodiment of the present invention.

Next, a manufacturing method of the non-oriented electrical steel sheet according to the embodiment of the present invention will be described while referring to FIG. 4 and FIG. 5. FIG. 4 is a flow chart illustrating one example of the manufacturing method of the non-oriented electrical steel sheet according to the embodiment of the present invention, and FIG. 5 are schematic views for explaining the manufacturing method of the non-oriented electrical steel sheet according to the embodiment of the present invention.

In the manufacturing method of the non-oriented electrical steel sheet according to the present embodiment, hot rolling of a steel ingot having the above-described chemical composition, hot-rolled sheet annealing, pickling, cold rolling, and finish annealing are performed. When an insulating coating film is formed on a surface of a base iron, the formation of the insulating coating film is performed after the above-described finish annealing.

First, as illustrated in FIG. 4, a steel ingot (slab) having the above-described chemical composition is heated, and the heated steel ingot is subjected to hot rolling, to thereby obtain a hot-rolled steel sheet (S101). By performing the hot rolling as above, on a surface of the base iron 11, a scale S which is mainly composed of Fe oxides is generated, as illustrated in FIG. 5(A). In this hot rolling, it can be considered that Mn inside the base iron 11 is dispersed in a nearly uniform manner. Although a heating temperature of the steel ingot when the steel ingot is subjected to the hot rolling is not particularly limited, it is preferably set to not less than 1050° C. nor more than 1200° C., for example. A sheet thickness of the hot-rolled steel sheet after the hot rolling is also not particularly limited, but, it is preferably set to about 1.5 mm to 3.0 mm, for example, by taking a final sheet thickness of the base iron into consideration.

As illustrated in FIG. 4, after performing the hot rolling, hot-rolled sheet annealing is performed (S103). In the manufacturing method of the non-oriented electrical steel sheet according to the present embodiment, the hot-rolled sheet annealing is performed while keeping a state where the scale S generated by the hot rolling is adhered, as illustrated in FIG. 5(B). By the scale S generated on the surface of the hot-rolled steel sheet and the atmosphere at the time of performing the hot-rolled sheet annealing, Mn contained in the base iron 11 is oxidized while being diffused in a direction of the scale. As a result of this, in the vicinity of the surface of the base iron 11, an Mn-concentrated layer 104 containing Mn oxides is formed, and on an inner layer side (base iron side) by several μm of the Mn-concentrated layer 104, a demanganization layer 103 is formed. The rest of the base iron 11 is a base material part 111 including a structure after the hot-rolled sheet annealing. As described above, in the manufacturing method of the non-oriented electrical steel sheet according to the present embodiment, the Mn-concentrated layer 104 is formed under a situation where Mn is more likely to be oxidized, so that an Mn concentration of the demanganization layer 103 being a supplying source of Mn to the Mn-concentrated layer 104 becomes further lower than the conventional one. For this reason, the demanganization layer having the concentration distribution of Mn as illustrated in FIG. 3 is formed. On the other hand, even if the scale S generated through the hot rolling is removed and then the hot-rolled sheet annealing is performed under conditions as will be described later, Mn in the vicinity of the surface layer of the base iron 11 is not sufficiently oxidized, and thus it is not possible to form the demanganization layer 103 as described above.

If a dew point in the annealing atmosphere in the hot-rolled sheet annealing is less than −40° C., a source of oxygen is only the scale on the surface layer, so that the demanganization layer is not sufficiently formed. Therefore, the dew point in the annealing atmosphere is set to −40° C. or more, preferably set to −20° C. or more, and more preferably set to −10° C. or more. On the other hand, if the dew point in the annealing atmosphere exceeds 60° C., Fe in the base iron is oxidized to generate a scale, and this scale is removed by pickling, resulting in that the yield deteriorates. Besides, when Fe in the base iron is oxidized, the Mn-concentrated layer and the demanganization layer disappear. Therefore, the dew point in the annealing atmosphere is set to 60° C. or less, preferably set to 50° C. or less, and more preferably set to 40° C. or less.

If a temperature in the hot-rolled sheet annealing is less than 900° C., crystal grains of the base iron do not become sufficiently coarse through the annealing, resulting in that it is not possible to obtain good magnetic properties. Therefore, the temperature in the hot-rolled sheet annealing is set to 900° C. or more, preferably set to 930° C. or more, and more preferably set to 950° C. or more. On the other hand, if the temperature in the hot-rolled sheet annealing exceeds 1100° C., the base iron is fractured in cold rolling to be described later. Therefore, the temperature in the hot-rolled sheet annealing is set to 1100° C. or less, preferably set to 1070° C. or less, and more preferably set to 1050° C. or less.

If a soaking time is less than 1 second, crystal grains of the base iron do not become sufficiently coarse through the annealing, resulting in that it is not possible to obtain good magnetic properties. Therefore, the soaking time is set to 1 second or more, preferably set to 10 seconds or more, and more preferably set to 30 seconds or more. On the other hand, if the soaking time exceeds 300 seconds, the base iron is fractured in the cold rolling to be described later. Therefore, the soaking time is set to 300 seconds or less, preferably set to 150 seconds or less, and more preferably set to 90 seconds or less.

Note that cooling in the hot-rolled sheet annealing is performed by setting a cooling rate in a temperature region from 800° C. to 500° C. to preferably 20° C./second to 100° C./second. By setting such a cooling rate, it is possible to obtain better magnetic properties.

As illustrated in FIG. 4, after the hot-rolled sheet annealing, pickling is performed (S105). In the pickling, a pickling weight loss is controlled so that the scale S and the Mn-concentrated layer 104 being an internal oxide layer positioned on the uppermost surface layer of the base iron 11 are removed to make the demanganization layer 103 to be the uppermost surface layer, as illustrated in FIG. 5(C). When performing the pickling, the Mn concentration in the depth direction is measured at any time by the GDS regarding the steel sheet in the middle of the pickling or after the pickling, and the pickling weight loss is controlled so that the non-oriented electrical steel sheet to be finally obtained satisfies the above-described expression 1. Note that the pickling weight loss can be controlled by changing at least any of a concentration of acid to be used for the pickling, a concentration of an accelerating agent used for the pickling, and a temperature of a pickling solution, for example. Concretely, the pickling is performed so that the base iron after the pickling satisfies the following expression 2, when an average value of Mn concentrations in a range from the surface of the base iron to a position where a depth from the surface of the base iron is 5 μm is set to $[Mn_5]$, and an Mn concentration at a position where a depth from the surface of the base iron is 10 μm is set to $[Mn_{10}]$. By controlling the pickling weight loss so that the following expression 2 is satisfied, the non-oriented electrical steel sheet to be finally obtained satisfies the above-described expression 1.

$$0.1 \leq [Mn_5]/[Mn_{10}] \leq 0.9 \quad \text{(Expression 2)}$$

As illustrated in FIG. 4, after the pickling, cold rolling is performed (S107). As illustrated in FIG. 5(D), in the cold rolling, the pickled sheet as a result of removing the scale S and the Mn-concentrated layer 104 is rolled at a reduction ratio by which a final sheet thickness of the base iron 11 becomes not less than 0.10 mm nor more than 0.35 mm. By performing the cold rolling, a base material part 121 including a cold-rolled structure is obtained.

As illustrated in FIG. 4, after the cold rolling, finish rolling is performed (step S109). As illustrated in FIG. 5(E), in the manufacturing method of the non-oriented electrical steel sheet according to the present embodiment, the demanganization layer 103 is formed by performing the hot-rolled sheet annealing, and after that, the demanganization layer 103 is maintained. If a finish annealing temperature is 900° C. or more, Mn is diffused from the base material part 121 to the demanganization layer 103, and the demanganization layer 103 disappears. Therefore, the finish annealing temperature is set to less than 900° C., preferably set to 880° C. or less, and more preferably set to 860° C. or less. By performing the finish annealing with such a finish annealing temperature, it is possible to obtain a base material part 101 including a fine recrystallization structure and capable of preferably causing recrystallization in strain relief annealing which is carried out when manufacturing a motor core. On the other than, if the finish annealing temperature is less than 750° C., an annealing time becomes excessively long, which sometimes lowers the productivity. Therefore, the finish annealing temperature is preferably set to 750° C. or more, and more preferably set to 775° C. or more.

Although the annealing time may be appropriately set in accordance with the finish annealing temperature, it can be set to 1 second to 150 seconds, for example. If the annealing time is less than 1 second, there is a case where sufficient finish annealing cannot be performed, and it becomes difficult to properly generate seed crystals in the base material part. Therefore, the annealing time is preferably set to 1 second or more, and more preferably set to 5 seconds or more. On the other hand, if the annealing time exceeds 150 seconds, the annealing time is excessively long, which sometimes lowers the productivity. Therefore, the annealing time is preferably set to 150 seconds or less, and more preferably set to 100 seconds or less.

A heating rate in a temperature region of 950° C. or less and 700° C. or more is preferably set to 10° C./s to 800° C./s. If the heating rate is less than 10° C./s, it is sometimes not possible to obtain good magnetic properties in the non-oriented electrical steel sheet. Therefore, the heating rate in the temperature region of 950° C. or less and 700° C. or more is preferably set to 10° C./s or more, and more preferably set to 100° C./s or more. On the other hand, if the heating rate exceeds 800° C./s, an effect of improving the magnetic properties is sometimes saturated. Therefore, the heating rate in the temperature region of 950° C. or less and 700° C. or more is preferably set to 800° C./s or less, and more preferably set to 400° C./s or less.

A cooling rate in a temperature region of 900° C. or less and 500° C. or more is preferably set to 10° C./s to 100° C./s. If the cooling rate is less than 10° C./s, it is sometimes not possible to obtain good magnetic properties in the non-oriented electrical steel sheet. Therefore, the cooling rate in the temperature region of 900° C. or less and 500° C. or more is preferably set to 10° C./s or more, and more preferably set to 20° C./s or more. On the other hand, if the cooling rate exceeds 100° C./s, an effect of improving the magnetic properties is sometimes saturated. Therefore, the cooling rate in the temperature region of 900° C. or less and 500° C. or more is preferably set to 100° C./s or less, and more preferably set to 70° C./s or less.

The non-oriented electrical steel sheet according to the embodiment of the present invention can be manufactured in the manner as described above.

As illustrated in FIG. 5(F), it is also possible to form an insulating coating film 13 according to need after the finish annealing (S111 in FIG. 4). A method of forming the insulating coating film 13 is not particularly limited, and it is only required that the publicly-known insulating coating film treatment solution as described above is used, and the treatment solution is coated and dried through publicly-known methods. Note that it is also possible that the surface of the base iron on which the insulating coating film is formed is subjected to, before the treatment solution is coated thereon, any pretreatment such as a degreasing treatment using alkali or the like, or a pickling treatment using hydrochloric acid, sulfuric acid, phosphoric acid, or the like, to a degree at which a large influence is not exerted on a state of the demanganization layer, a thickness of the demanganization layer, and the like. Further, it is also possible that the insulating coating film is formed on the surface which is left as it is after the finish annealing without performing these pretreatments.

Figure 6:
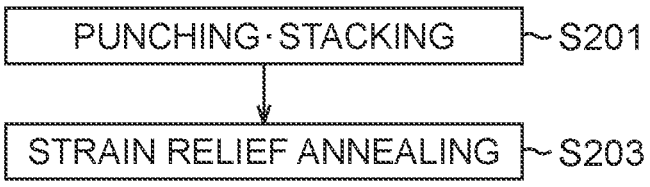
FIG. 6 is a flow chart illustrating one example of a manufacturing method of a motor core according to an embodiment of the present invention.

Next, a manufacturing method of a motor core according to an embodiment of the present invention will be described while referring to FIG. 6. FIG. 6 is a flow chart illustrating one example of the manufacturing method of the motor core according to the embodiment of the present invention.

First, the non-oriented electrical steel sheets according to the present embodiment are punched in a core shape, and the punched non-oriented electrical steel sheets are stacked (S201), to thereby form a desired shape of a motor core. Since the non-oriented electrical steel sheets punched in the core shape are stacked, it is important that the non-oriented electrical steel sheet used for manufacturing the motor core is one in which the insulating coating film is formed on the surface of the base iron.

After that, strain relief annealing (core annealing) is performed on the non-oriented electrical steel sheets stacked in the core shape (S203).

If a proportion of nitrogen in an atmosphere in the strain relief annealing is less than 70 volume %, a cost of the strain relief annealing increases. Therefore, the proportion of nitrogen in the atmosphere in the strain relief annealing is set to 70 volume % or more, preferably set to 80 volume % or more, more preferably set to 90 volume % to 100 volume %, and particularly preferably set to 97 volume % to 100 volume %. Note that an atmosphere gas other than nitrogen is not particularly limited, and generally, it is possible to use a reducing mixed gas made of hydrogen, carbon dioxide, carbon monoxide, water vapor, methane, and the like. A method of burning a propane gas or a natural gas is generally adopted for obtaining the gas of these.

If an annealing temperature in the strain relief annealing is less than 750° C., it is not possible to sufficiently relieve the strain accumulated in the non-oriented electrical steel sheet. Therefore, the annealing temperature in the strain relief annealing is set to 750° C. or more, and preferably set to 775° C. or more. On the other hand, if the annealing temperature in the strain relief annealing exceeds 900° C., the grain growth of the recrystallization structure excessively progresses, and the eddy current loss is increased although a hysteresis loss is lowered, resulting in that the entire core loss is increased on the contrary. Therefore, the annealing temperature in the strain relief annealing is set to 900° C. or less, and preferably set to 850° C. or less.

Although an annealing time in the strain relief annealing may be appropriately set in accordance with the annealing temperature, it can be set to 10 minutes to 180 minutes, for example. If the annealing time is less than 10 minutes, it is sometimes not possible to sufficiently relieve the strain. Therefore, the annealing time is preferably set to 10 minutes or more, and more preferably set to 30 minutes or more. On the other hand, if the annealing time exceeds 180 minutes, the annealing time is excessively long, which sometimes lowers the productivity. Therefore, the annealing time is preferably set to 180 minutes or less, and more preferably set to 150 minutes or less.

A heating rate in a temperature region of not less than 500° C. nor more than 750° C. in the strain relief annealing is preferably set to 50° C./Hr to 300° C./Hr. If the heating rate is less than 50° C./Hr, it is sometimes not possible to obtain good magnetic properties and the like in the motor core. Therefore, the heating rate in the temperature region of not less than 500° C. nor more than 750° C. is preferably set to 50° C./Hr or more, and more preferably set to 80° C./Hr or more. On the other hand, if the heating rate exceeds 300° C./Hr, an effect of improving the magnetic properties and the like is sometimes saturated. Therefore, the heating rate in the temperature region of not less than 500° C. nor more than 750° C. is preferably set to 300° C./Hr or less, and more preferably set to 150° C./Hr or less.

A cooling rate in a temperature region of 750° C. or less and 500° C. or more in the strain relief annealing is preferably set to 50° C./Hr to 500° C./Hr. If the cooling rate is less than 50° C./Hr, it is sometimes not possible to obtain good magnetic properties and the like in the motor core. Therefore, the cooling rate in the temperature region of 750° C. or less and 500° C. or more is preferably set to 50° C./Hr or more, and more preferably set to 80° C./Hr or more. On the other hand, if the cooling rate exceeds 500° C./Hr, there is a case where a cooling unevenness occurs and a strain due to a thermal stress is easily introduced, resulting in that the core loss deteriorates. Therefore, the cooling rate in the temperature region of 750° C. or less and 500° C. or more is preferably set to 500° C./Hr or less, and more preferably set to 200° C./Hr or less.

The motor core using the non-oriented electrical steel sheet according to the embodiment of the present invention can be manufactured in the manner as described above.

EXAMPLES

Next, examples of the present invention will be described. A condition in the examples is a case of condition adopted to confirm feasibility and an effect of the present invention, and the present invention is not limited to this case of the condition. In the present invention, it is possible to adopt various conditions as long as the object of the present invention is achieved without departing from the gist of the present invention.

Example 1

Slabs having chemical compositions presented in Table 1 were heated to 1150° C., and after that, the slabs were subjected to hot rolling in which a finish rolling temperature was set to 850° C. and a finish sheet thickness was set to 2.0 mm, and coiled at 650° C., to thereby obtain hot-rolled steel sheets. While keeping a state where scales generated on the surfaces of the steel sheets were adhered, the steel sheets were subjected to hot-rolled sheet annealing at 1000° C. for 50 seconds in a nitrogen atmosphere with a dew point in the atmosphere set to 10° C., and then subjected to pickling with hydrochloric acid. When performing the pickling, an acid concentration of an acid solution, a temperature, and a time when performing the pickling were changed to manufacture pickled sheets in each of which the above-described value of $[Mn_5]/[Mn_{10}]$ takes a value as indicated in Table 2 and Table 3. These pickled sheets were subjected to cold rolling to realize a sheet thickness of 0.25 mm, thereby obtaining cold-rolled steel sheets. After that, finish annealing was conducted under conditions indicated in Table 2 and Table 3 in a mixed atmosphere containing 20% of hydrogen and 80% of nitrogen and setting a dew point to 0° C., and insulating coating films were coated, to thereby obtain non-oriented electrical steel sheets. Note that a cooling rate in a temperature region from 800° C. to 500° C. when performing the hot-rolled sheet annealing was set to 40° C./second, a heating rate in a temperature region of 950° C. or less and 700° C. or more when performing the finish annealing was set to 100° C./second, and a cooling rate in a temperature region of 900° C. or less and 500° C. or more when performing the finish annealing was set to 30° C./second. The insulating coating film was formed in a manner that the insulating coating film made of aluminum phosphate and an acrylic-styrene copolymer resin emulsion with a grain diameter of 0.2 μm was coated to satisfy a predetermined adhesion amount, and baked at 350° C. in the atmosphere. An analysis of an Mn concentration distribution with the GDS and an analysis of a nitrogen concentration in the steel were performed after removing the insulating coating film by using hot alkali. An underline in Table 1 to Table 3 indicates that the underlined numeric value is out of the range of the present invention.

TABLE 1

| STEEL | CHEMICAL COMPOSITION (MASS %) | | | | | | | | |
|---|---|---|---|---|---|---|---|---|---|
| TYPE | C | Si | Al | Mn | P | S | Ti | N | OPTIONAL ELEMENT |
| A | 0.0023 | 3.2 | 0.7 | 1.2 | 0.02 | 0.0005 | 0.0009 | 0.0017 | — |
| B | 0.0018 | 3.3 | 0.0009 | 2.3 | 0.005 | 0.0008 | 0.0014 | 0.0016 | — |
| C | 0.0015 | 2.9 | 0.7 | 0.8 | 0.09 | 0.0021 | 0.0015 | 0.0023 | Sn = 0.05 |
| D | 0.0021 | 3.1 | 0.6 | 0.3 | 0.03 | 0.0013 | 0.0007 | 0.0021 | Ni = 0.05, Cr = 0.06, Cu = 0.08 |
| E | 0.0015 | 2.9 | 1.2 | 0.5 | 0.01 | 0.0009 | 0.0013 | 0.0018 | Ca = 0.0011 |
| F | 0.0023 | 2.8 | 0.6 | 2.1 | 0.01 | 0.0021 | 0.0014 | 0.0013 | — |
| G | 0.0016 | 3.6 | 0.01 | 1.1 | 0.04 | 0.0008 | 0.0018 | 0.0022 | — |
| H | 0.0029 | 3.6 | 0.0001 | 2.6 | 0.008 | 0.0023 | 0.0013 | 0.0011 | — |
| I | 0.0011 | 3.7 | 0.0003 | 1.8 | 0.009 | 0.0015 | 0.0007 | 0.0013 | — |

TABLE 1-continued

| STEEL | CHEMICAL COMPOSITION (MASS %) | | | | | | | | |
|---|---|---|---|---|---|---|---|---|---|
| TYPE | C | Si | Al | Mn | P | S | Ti | N | OPTIONAL ELEMENT |
| J | 0.0013 | 2.9 | 1.8 | 0.4 | 0.01 | 0.0014 | 0.0016 | 0.0023 | — |
| K | 0.0021 | 2.7 | 2.0 | 0.3 | 0.01 | 0.0009 | 0.0013 | 0.0022 | — |
| L | 0.0014 | 2.6 | 2.3 | 0.5 | 0.007 | 0.0021 | 0.0018 | 0.0019 | — |
| M | 0.0022 | 3.5 | 0.4 | 0.1 | 0.02 | 0.0026 | 0.0023 | 0.0022 | — |
| N | 0.0013 | 3.3 | 1.2 | 0.2 | 0.01 | 0.0006 | 0.0019 | 0.0016 | — |
| O | 0.0019 | 3.1 | 0.3 | 2.6 | 0.04 | 0.0011 | 0.0015 | 0.0011 | — |
| P | 0.0022 | 2.8 | 0.5 | 3.0 | 0.02 | 0.0006 | 0.0022 | 0.0021 | — |
| Q | 0.0026 | 3.3 | 0.8 | 0.05 | 0.008 | 0.0022 | 0.0023 | 0.0018 | — |
| R | 0.0027 | 2.6 | 1 | 3.3 | 0.009 | 0.0027 | 0.0018 | 0.0018 | — |

TABLE 2

| | | PICKLING | | | | FINISH ANNEALING | | | STEEL SHEET | | |
|---|---|---|---|---|---|---|---|---|---|---|---|
| STEEL No. | STEEL TYPE | CONCENTRATION (mol/l) | TEMPERATURE (° C.) | TIME (SECOND) | $[Mn_5]/[Mn_{10}]$ | TEMPERATURE (° C.) | TIME (SECOND) | $[Mn_2]/[Mn_{10}]$ | AVERAGE CRYSTAL GRAIN DIAMETER (μm) | STRENGTH | REMARKS |
| 1 | A | 3 | 70 | 30 | 0.3 | 770 | 20 | 0.4 | 12 | ○ | INVENTION EXAMPLE |
| 2 | | | | | | 780 | 60 | 0.5 | 22 | ○ | INVENTION EXAMPLE |
| 3 | | | | | | 880 | 5 | 0.6 | 30 | ○ | INVENTION EXAMPLE |
| 4 | | | | | | 980 | 20 | 1.0 | 66 | X | COMPARATIVE EXAMPLE |
| 5 | | 3 | 80 | 40 | 0.5 | 790 | 20 | 0.6 | 17 | ○ | INVENTION EXAMPLE |
| 6 | | | | | | 870 | 20 | 0.8 | 38 | ○ | INVENTION EXAMPLE |
| 7 | | | | | | 880 | 20 | 0.8 | 40 | ○ | INVENTION EXAMPLE |
| 8 | | | | | | 1015 | 5 | 1.1 | 64 | X | COMPARATIVE EXAMPLE |
| 9 | | 4 | 80 | 40 | 0.8 | 760 | 130 | 0.9 | 22 | ○ | INVENTION EXAMPLE |
| 10 | | | | | | 800 | 20 | 0.9 | 20 | ○ | INVENTION EXAMPLE |
| 11 | | | | | | 890 | 1 | 0.9 | 21 | ○ | INVENTION EXAMPLE |
| 12 | | | | | | 970 | 20 | 1.3 | 64 | X | COMPARATIVE EXAMPLE |
| 13 | | 9 | 90 | 90 | 1.0 | 800 | 15 | 1.2 | 18 | ○ | COMPARATIVE EXAMPLE |
| 14 | | | | | | 890 | 10 | 1.4 | 38 | ○ | COMPARATIVE EXAMPLE |
| 15 | | | | | | 1010 | 15 | 1.6 | 72 | X | COMPARATIVE EXAMPLE |
| 16 | B | 3 | 80 | 30 | 0.4 | 780 | 100 | 0.6 | 25 | ○ | INVENTION EXAMPLE |
| 17 | | | | | | 870 | 5 | 0.6 | 28 | ○ | INVENTION EXAMPLE |
| 18 | | | | | | 1050 | 10 | 1.2 | 78 | X | COMPARATIVE EXAMPLE |
| 19 | | 3 | 80 | 40 | 0.6 | 810 | 20 | 0.7 | 22 | ○ | INVENTION EXAMPLE |
| 20 | | | | | | 870 | 10 | 0.8 | 33 | ○ | INVENTION EXAMPLE |
| 21 | | | | | | 980 | 30 | 1.4 | 69 | X | COMPARATIVE EXAMPLE |
| 22 | | 6 | 90 | 90 | 1.0 | 800 | 70 | 1.2 | 28 | ○ | COMPARATIVE EXAMPLE |
| 23 | | | | | | 900 | 10 | 1.3 | 40 | ○ | COMPARATIVE EXAMPLE |
| 24 | | | | | | 1030 | 40 | 1.7 | 85 | X | COMPARATIVE EXAMPLE |
| 25 | C | 3 | 80 | 30 | 0.6 | 830 | 5 | 0.7 | 18 | ○ | INVENTION EXAMPLE |
| 26 | | | | | | 860 | 6 | 0.8 | 27 | ○ | INVENTION EXAMPLE |

TABLE 2-continued

| STEEL No. | STEEL TYPE | PICKLING CONCENTRATION (mol/l) | PICKLING TEMPERATURE (° C.) | PICKLING TIME (SECOND) | PICKLING $[Mn_5]/[Mn_{10}]$ | FINISH ANNEALING TEMPERATURE (° C.) | FINISH ANNEALING TIME (SECOND) | FINISH ANNEALING $[Mn_2]/[Mn_{10}]$ | STEEL SHEET AVERAGE CRYSTAL GRAIN DIAMETER (μm) | STEEL SHEET STRENGTH | REMARKS |
|---|---|---|---|---|---|---|---|---|---|---|---|
| 27 | | | | | | 1050 | 15 | 1.2 | 82 | X | COMPARATIVE EXAMPLE |
| 28 | | 6 | 80 | 40 | 0.8 | 820 | 10 | 0.9 | 20 | ○ | INVENTION EXAMPLE |
| 29 | | | | | | 970 | 30 | 1.3 | 67 | X | COMPARATIVE EXAMPLE |
| 30 | D | 3 | 80 | 30 | 0.7 | 800 | 15 | 0.8 | 18 | ○ | INVENTION EXAMPLE |
| 31 | | | | | | 850 | 5 | 0.8 | 23 | ○ | INVENTION EXAMPLE |
| 32 | | | | | | 1000 | 60 | 1.4 | 80 | X | COMPARATIVE EXAMPLE |
| 33 | | 6 | 80 | 40 | 0.8 | 830 | 10 | 0.9 | 23 | ○ | INVENTION EXAMPLE |
| 34 | | | | | | 870 | 2 | 0.9 | 21 | ○ | INVENTION EXAMPLE |
| 35 | | | | | | 1030 | 20 | 1.4 | 79 | X | COMPARATIVE EXAMPLE |
| 36 | E | 4 | 80 | 30 | 0.7 | 840 | 10 | 0.8 | 25 | ○ | INVENTION EXAMPLE |
| 37 | | | | | | 1050 | 10 | 1.3 | 78 | X | COMPARATIVE EXAMPLE |
| 38 | | 6 | 80 | 60 | 0.8 | 780 | 50 | 0.8 | 21 | ○ | INVENTION EXAMPLE |
| 39 | | | | | | 890 | 1 | 0.9 | 21 | ○ | INVENTION EXAMPLE |
| 40 | | | | | | 960 | 10 | 1.2 | 56 | X | COMPARATIVE EXAMPLE |
| 41 | F | 3 | 80 | 30 | 0.5 | 800 | 20 | 0.6 | 20 | ○ | INVENTION EXAMPLE |
| 42 | | | | | | 1000 | 30 | 1.1 | 75 | X | COMPARATIVE EXAMPLE |
| 43 | | 6 | 80 | 60 | 0.8 | 760 | 80 | 0.9 | 19 | ○ | INVENTION EXAMPLE |
| 44 | | | | | | 850 | 5 | 0.9 | 23 | ○ | INVENTION EXAMPLE |
| 45 | | | | | | 1025 | 15 | 1.4 | 75 | X | COMPARATIVE EXAMPLE |
| 46 | G | 3 | 80 | 30 | 0.6 | 800 | 10 | 0.7 | 15 | ○ | INVENTION EXAMPLE |
| 47 | | | | | | 890 | 30 | 0.8 | 46 | ○ | INVENTION EXAMPLE |
| 48 | | | | | | 980 | 20 | 1.1 | 66 | ○ | COMPARATIVE EXAMPLE |
| 49 | | 6 | 80 | 40 | 0.7 | 850 | 5 | 0.8 | 23 | ○ | INVENTION EXAMPLE |
| 50 | | | | | | 1050 | 5 | 1.3 | 73 | ○ | COMPARATIVE EXAMPLE |

TABLE 3

| STEEL No. | STEEL TYPE | PICKLING CONCENTRATION (mol/l) | PICKLING TEMPERATURE (° C.) | PICKLING TIME (SECOND) | PICKLING $[Mn_5]/[Mn_{10}]$ | FINISH ANNEALING TEMPERATURE (° C.) | FINISH ANNEALING TIME (SECOND) | FINISH ANNEALING $[Mn_2]/[Mn_{10}]$ | STEEL SHEET AVERAGE CRYSTAL GRAIN DIAMETER (μm) | STEEL SHEET STRENGTH | REMARKS |
|---|---|---|---|---|---|---|---|---|---|---|---|
| 51 | H | 3 | 80 | 30 | 0.5 | 780 | 80 | 0.7 | 15 | ○ | INVENTION EXAMPLE |
| 52 | | | | | | 800 | 20 | 0.6 | 12 | ○ | INVENTION EXAMPLE |
| 53 | | | | | | 1020 | 30 | 1.2 | 67 | ○ | COMPARATIVE EXAMPLE |
| 54 | | 4 | 90 | 30 | 0.7 | 820 | 15 | 0.8 | 14 | ○ | INVENTION EXAMPLE |

TABLE 3-continued

| STEEL No. | STEEL TYPE | PICKLING CONCENTRATION (mol/l) | PICKLING TEMPERATURE (° C.) | PICKLING TIME (SECOND) | PICKLING $[Mn_5]/[Mn_{10}]$ | FINISH ANNEALING TEMPERATURE (° C.) | FINISH ANNEALING TIME (SECOND) | FINISH ANNEALING $[Mn_2]/[Mn_{10}]$ | STEEL SHEET AVERAGE CRYSTAL GRAIN DIAMETER (μm) | STEEL SHEET STRENGTH | REMARKS |
|---|---|---|---|---|---|---|---|---|---|---|---|
| 55 | | | | | | 980 | 40 | 1.3 | 59 | ○ | COMPARATIVE EXAMPLE |
| 56 | I | 3 | 80 | 30 | 0.6 | 780 | 80 | 0.7 | 17 | ○ | INVENTION EXAMPLE |
| 57 | | | | | | 800 | 20 | 0.7 | 13 | ○ | INVENTION EXAMPLE |
| 58 | | | | | | 1020 | 30 | 1.1 | 75 | ○ | COMPARATIVE EXAMPLE |
| 59 | | 4 | 90 | 30 | 0.7 | 820 | 15 | 0.8 | 16 | ○ | INVENTION EXAMPLE |
| 60 | | | | | | 980 | 40 | 1.0 | 67 | ○ | COMPARATIVE EXAMPLE |
| 61 | J | 3 | 80 | 30 | 0.4 | 780 | 80 | 0.6 | 18 | ○ | INVENTION EXAMPLE |
| 62 | | | | | | 800 | 20 | 0.6 | 14 | ○ | INVENTION EXAMPLE |
| 63 | | | | | | 1020 | 30 | 1.0 | 79 | X | COMPARATIVE EXAMPLE |
| 64 | | 4 | 90 | 30 | 0.8 | 820 | 15 | 0.9 | 17 | ○ | INVENTION EXAMPLE |
| 65 | | | | | | 980 | 40 | 1.4 | 70 | X | COMPARATIVE EXAMPLE |
| 66 | K | 3 | 80 | 30 | 0.5 | 780 | 80 | 0.7 | 19 | ○ | INVENTION EXAMPLE |
| 67 | | | | | | 800 | 20 | 0.6 | 14 | ○ | INVENTION EXAMPLE |
| 68 | | | | | | 1020 | 30 | 1.1 | 83 | X | COMPARATIVE EXAMPLE |
| 69 | | 4 | 90 | 30 | 0.7 | 820 | 15 | 0.8 | 18 | ○ | INVENTION EXAMPLE |
| 70 | | | | | | 980 | 40 | 1.3 | 74 | X | COMPARATIVE EXAMPLE |
| 71 | L | 3 | 80 | 30 | 0.9 | 800 | 20 | 1.0 | 13 | ○ | COMPARATIVE EXAMPLE |
| 72 | M | 3 | 80 | 30 | 0.5 | 780 | 80 | 0.7 | 16 | ○ | INVENTION EXAMPLE |
| 73 | | | | | | 800 | 20 | 0.6 | 12 | ○ | INVENTION EXAMPLE |
| 74 | | | | | | 1020 | 30 | 1.1 | 71 | X | COMPARATIVE EXAMPLE |
| 75 | | 4 | 90 | 30 | 0.8 | 820 | 15 | 0.9 | 15 | ○ | INVENTION EXAMPLE |
| 76 | | | | | | 980 | 40 | 1.4 | 63 | X | COMPARATIVE EXAMPLE |
| 77 | N | 3 | 80 | 30 | 0.4 | 780 | 80 | 0.6 | 19 | ○ | INVENTION EXAMPLE |
| 78 | | | | | | 800 | 20 | 0.6 | 14 | ○ | INVENTION EXAMPLE |
| 79 | | | | | | 1020 | 30 | 1.0 | 83 | X | COMPARATIVE EXAMPLE |
| 80 | | 4 | 90 | 30 | 0.7 | 820 | 15 | 0.8 | 18 | ○ | INVENTION EXAMPLE |
| 81 | | | | | | 980 | 40 | 1.3 | 74 | ○ | COMPARATIVE EXAMPLE |
| 82 | O | 3 | 80 | 30 | 0.4 | 780 | 80 | 0.6 | 18 | ○ | INVENTION EXAMPLE |
| 83 | | | | | | 800 | 20 | 0.6 | 14 | ○ | INVENTION EXAMPLE |
| 84 | | | | | | 1020 | 30 | 1.0 | 79 | X | COMPARATIVE EXAMPLE |
| 85 | | 4 | 90 | 30 | 0.8 | 820 | 15 | 0.9 | 17 | ○ | INVENTION EXAMPLE |
| 86 | | | | | | 980 | 40 | 1.4 | 70 | X | COMPARATIVE EXAMPLE |
| 87 | P | 3 | 80 | 30 | 0.5 | 780 | 80 | 0.7 | 19 | ○ | INVENTION EXAMPLE |
| 88 | | | | | | 800 | 20 | 0.6 | 14 | ○ | INVENTION EXAMPLE |
| 89 | | | | | | 1020 | 30 | 1.1 | 83 | X | COMPARATIVE EXAMPLE |

TABLE 3-continued

| STEEL No. | STEEL TYPE | PICKLING CONCENTRATION (mol/l) | PICKLING TEMPERATURE (° C.) | PICKLING TIME (SECOND) | PICKLING $[Mn_5]/[Mn_{10}]$ | FINISH ANNEALING TEMPERATURE (° C.) | FINISH ANNEALING TIME (SECOND) | FINISH ANNEALING $[Mn_2]/[Mn_{10}]$ | STEEL SHEET AVERAGE CRYSTAL GRAIN DIAMETER (μm) | STEEL SHEET STRENGTH | REMARKS |
|---|---|---|---|---|---|---|---|---|---|---|---|
| 90 | | 4 | 90 | 30 | 0.6 | 820 | 15 | 0.7 | 18 | ○ | INVENTION EXAMPLE |
| 91 | | | | | | 980 | 40 | 1.2 | 74 | X | COMPARATIVE EXAMPLE |
| 92 | Q | 3 | 80 | 30 | 0.9 | 800 | 20 | 1.0 | 14 | ○ | COMPARATIVE EXAMPLE |
| 93 | R | 3 | 80 | 30 | 0.9 | 800 | 20 | 1.0 | 12 | ○ | COMPARATIVE EXAMPLE |

The samples of No. 13 to No. 15, and No. 22 to No. 24 in Table 2 are pickled sheets with uniform Mn concentration in the sheet thickness direction, and they seem to be ideal pickled sheets from a viewpoint which is not based on the findings of the present invention. However, since Mn in the steel was oxidized at the surface of the steel sheet due to mixing of a very small amount of moisture when performing the finish annealing and the Mn-concentrated layer was formed, so that the value of $[Mn_2]/[Mn_{10}]$ after the finish annealing is out of the range of the present invention.

In each of the samples of No. 1 to No. 3, No. 5 to No. 7, No. 9 to No. 11, No. 16, No. 17, No. 19, No. 20, No. 25, No. 26, No. 28, No. 30, No. 31, No. 33, No. 34, No. 36, No. 38, No. 39, No. 41, No. 43, No. 44, No. 46, No. 47, No. 49 in Table 2, and the samples of No. 51, No. 52, No. 54, No. 61, No. 62, No 64, No. 66, No. 67, No. 69, No. 72, No. 73, No. 75, No. 77, No. 78, No. 80, No. 82, No. 83, No. 85, No. 87, No. 88, No. 90 in Table 3, the value of $[Mn_2]/[Mn_{10}]$ after the finish annealing is within the range of the present invention.

Regarding each of the samples of No. 4, No. 8, No. 12, No. 18, No. 21, No. 27, No. 29, No. 32, No. 35, No. 37, No. 40, No. 42, No. 45, No. 48, No. 50 in Table 2, and the samples of No. 53, No. 55, No. 58, No. 60, No. 63, No. 65, No. 68, No. 70, No. 74, No. 76, No. 79, No. 81, No. 84, No. 86, No. 89, No. 91 in Table 3, although the value of $[Mn_5]/[Mn_{10}]$ is within the range of the present invention, since the finish annealing temperature exceeds 900° C., Mn from the inside is diffused and the Mn-concentrated layer is formed due to the oxidation at the surface layer, resulting in that the value of $[Mn_2]/[Mn_{10}]$ after the finish annealing is out of the range of the present invention.

A motor core was manufactured by using a part of the obtained non-oriented electrical steel sheets. The non-oriented electrical steel sheets were punched to satisfy conditions of an outside diameter of stator of 140 mm, an outside diameter of rotor of 85 mm, 18 slots, and 12 poles, and stacked to be formed as a motor core. On the rotor side, a permanent magnet was embedded, and the stator side was subjected to strain relief annealing at 825° C. for 1 hour in a rich gas atmosphere with 70% of nitrogen and then a winding was provided. The obtained motor core was excited under conditions satisfying a magnetic flux density of a teeth part of 1.0 T, a torque of 2.5 Nm, and a rotation speed of 8000 rpm. Results of measuring motor core losses at that time are indicated in Table 4. Note that regarding the motor core loss indicated in Table 4, a residual obtained by subtracting a motor output, a copper loss, and a mechanical loss from an input power amount was evaluated as the core loss. An underline in Table 4 indicates that the underlined numeric value is out of the range of the present invention.

TABLE 4

| No. | STEEL No. | STEEL TYPE | $[Mn_2]/[Mn_{10}]$ | INSULATING COATING FILM ADHESION AMOUNT ($mg/m^2$) | INSULATING COATING FILM Fe CONTENT ($mg/m^2$) | STRAIN RELIEF ANNEALING TEMPERATURE (° C.) | STRAIN RELIEF ANNEALING INCREASING AMOUNT OF NITROGEN (%) | CORE LOSS OF MOTOR CORE (W/kg) | ADHESIVENESS OF COATING FILM | REMARKS |
|---|---|---|---|---|---|---|---|---|---|---|
| 101 | 1 | A | 0.39 | 1000 | 160 | 800 | 0.0002 | 59 | ○ | INVENTION EXAMPLE |
| 102 | | | | | | 850 | 0.0008 | 60 | ○ | INVENTION EXAMPLE |
| 103 | 5 | | 0.61 | 200 | 5 | 800 | 0.0002 | 59 | X | COMPARATIVE EXAMPLE |
| 104 | | | | 300 | 8 | 800 | 0.0003 | 59 | Δ | COMPARATIVE EXAMPLE |
| 105 | | | | 400 | 30 | 800 | 0.0002 | 59 | ○ | INVENTION EXAMPLE |
| 106 | | | | 800 | 100 | 800 | 0.0002 | 59 | ○ | INVENTION EXAMPLE |
| 107 | | | | 1000 | 130 | 750 | 0.0002 | 59 | ○ | INVENTION EXAMPLE |
| 108 | | | | | | 800 | 0.0002 | 59 | ○ | INVENTION EXAMPLE |

TABLE 4-continued

| No. | STEEL No. | STEEL TYPE | $[Mn_2]/[Mn_{10}]$ | INSULATING COATING FILM ADHESION AMOUNT ($mg/m^2$) | INSULATING COATING FILM Fe CONTENT ($mg/m^2$) | STRAIN RELIEF ANNEALING TEMPERATURE (° C.) | STRAIN RELIEF ANNEALING INCREASING AMOUNT OF NITROGEN (%) | CORE LOSS OF MOTOR CORE (W/kg) | ADHESIVENESS OF COATING FILM | REMARKS |
|---|---|---|---|---|---|---|---|---|---|---|
| 109 | | | | | | 850 | 0.0008 | 60 | ○ | INVENTION EXAMPLE |
| 110 | | | | | | 950 | 0.0023 | 65 | X | COMPARATIVE EXAMPLE |
| 111 | | | | 1200 | 180 | 800 | 0.0002 | 59 | ○ | INVENTION EXAMPLE |
| 112 | | | | 2000 | 270 | 800 | 0.0003 | 59 | Δ | COMPARATIVE EXAMPLE |
| 113 | 6 | | 0.79 | 1000 | 40 | 800 | 0.0008 | 60 | ○ | INVENTION EXAMPLE |
| 114 | 10 | | 0.85 | 1000 | 20 | 800 | 0.0007 | 60 | ○ | INVENTION EXAMPLE |
| 115 | 4 | | 1.0 | 1000 | 8 | 800 | 0.0015 | 62 | X | COMPARATIVE EXAMPLE |
| 116 | 13 | | 1.2 | 1000 | 3 | 800 | 0.0020 | 63 | X | COMPARATIVE EXAMPLE |
| 117 | 15 | | 1.6 | 1000 | 4 | 800 | 0.0025 | 64 | X | COMPARATIVE EXAMPLE |
| 118 | 16 | B | 0.6 | 1000 | 90 | 800 | 0.0005 | 59 | ○ | INVENTION EXAMPLE |
| 119 | | | | | | 850 | 0.0009 | 60 | ○ | INVENTION EXAMPLE |
| 120 | 19 | | 0.7 | 200 | 4 | 800 | 0.0007 | 60 | Δ | COMPARATIVE EXAMPLE |
| 121 | | | | 1000 | 70 | 800 | 0.0006 | 59 | ○ | INVENTION EXAMPLE |
| 122 | | | | | | 850 | 0.0009 | 59 | ○ | INVENTION EXAMPLE |
| 123 | | | | | | 950 | 0.0025 | 65 | X | COMPARATIVE EXAMPLE |
| 124 | 18 | | 1.2 | 1000 | 8 | 800 | 0.0021 | 62 | X | COMPARATIVE EXAMPLE |
| 125 | 22 | | 1.2 | 1000 | 6 | 800 | 0.0023 | 63 | X | COMPARATIVE EXAMPLE |
| 126 | 25 | C | 0.7 | 1000 | 60 | 800 | 0.0006 | 60 | ○ | INVENTION EXAMPLE |
| 127 | 29 | | 1.3 | 1000 | 5 | 800 | 0.0024 | 65 | X | COMPARATIVE EXAMPLE |
| 128 | 31 | D | 0.8 | 1000 | 50 | 800 | 0.0007 | 60 | ○ | INVENTION EXAMPLE |
| 129 | 35 | | 1.4 | 1000 | 6 | 800 | 0.0024 | 66 | X | COMPARATIVE EXAMPLE |
| 130 | 36 | E | 0.8 | 1000 | 30 | 800 | 0.0007 | 60 | ○ | INVENTION EXAMPLE |
| 131 | 40 | | 1.2 | 1000 | 7 | 800 | 0.0018 | 65 | X | COMPARATIVE EXAMPLE |
| 132 | 41 | F | 0.6 | 1000 | 110 | 800 | 0.0004 | 59 | ○ | INVENTION EXAMPLE |
| 133 | 45 | | 1.4 | 1000 | 7 | 800 | 0.0022 | 62 | X | COMPARATIVE EXAMPLE |
| 134 | 47 | G | 0.8 | 1000 | 50 | 800 | 0.0008 | 59 | ○ | INVENTION EXAMPLE |
| 135 | 48 | | 1.1 | 1000 | 6 | 800 | 0.0018 | 63 | X | COMPARATIVE EXAMPLE |
| 136 | 52 | H | 0.6 | 1000 | 100 | 800 | 0.0005 | 58 | ○ | INVENTION EXAMPLE |
| 137 | 53 | | 1.2 | 1000 | 7 | 800 | 0.0019 | 62 | X | COMPARATIVE EXAMPLE |
| 138 | 59 | I | 0.8 | 1000 | 60 | 800 | 0.0007 | 59 | ○ | INVENTION EXAMPLE |
| 139 | 60 | | 1.0 | 1000 | 9 | 800 | 0.0017 | 63 | X | COMPARATIVE EXAMPLE |
| 140 | 62 | J | 0.6 | 1000 | 100 | 800 | 0.0005 | 59 | ○ | INVENTION EXAMPLE |
| 141 | 65 | | 1.4 | 1000 | 4 | 800 | 0.0029 | 64 | X | COMPARATIVE EXAMPLE |
| 142 | 66 | K | 0.7 | 1000 | 50 | 800 | 0.0004 | 59 | ○ | INVENTION EXAMPLE |
| 143 | 70 | | 1.3 | 1000 | 6 | 800 | 0.0028 | 64 | X | COMPARATIVE EXAMPLE |
| 144 | 71 | L | 1.0 | 1000 | 6 | 800 | 0.0018 | 63 | X | COMPARATIVE EXAMPLE |

TABLE 4-continued

| No. | STEEL No. | STEEL TYPE | $[Mn_2]/[Mn_{10}]$ | INSULATING COATING FILM: ADHESION AMOUNT ($mg/m^2$) | INSULATING COATING FILM: Fe CONTENT ($mg/m^2$) | STRAIN RELIEF ANNEALING: TEMPERATURE (° C.) | STRAIN RELIEF ANNEALING: INCREASING AMOUNT OF NITROGEN (%) | CORE LOSS OF MOTOR CORE (W/kg) | ADHESIVENESS OF COATING FILM | REMARKS |
|---|---|---|---|---|---|---|---|---|---|---|
| 145 | 75 | M | 0.9 | 1000 | 30 | 800 | 0.0004 | 60 | ○ | INVENTION EXAMPLE |
| 146 | 76 | | 1.4 | 1000 | 7 | 800 | 0.0029 | 66 | X | COMPARATIVE EXAMPLE |
| 147 | 78 | N | 0.6 | 1000 | 110 | 800 | 0.0004 | 60 | ○ | INVENTION EXAMPLE |
| 148 | 79 | | 1.0 | 1000 | 4 | 800 | 0.0020 | 63 | X | COMPARATIVE EXAMPLE |
| 149 | 83 | O | 0.6 | 1000 | 110 | 800 | 0.0004 | 59 | ○ | INVENTION EXAMPLE |
| 150 | 86 | | 1.4 | 1000 | 3 | 800 | 0.0031 | 64 | X | COMPARATIVE EXAMPLE |
| 151 | 88 | P | 0.6 | 1000 | 100 | 800 | 0.0003 | 59 | ○ | INVENTION EXAMPLE |
| 152 | 91 | | 1.2 | 1000 | 6 | 800 | 0.0022 | 63 | X | COMPARATIVE EXAMPLE |
| 153 | 92 | Q | 1.0 | 1000 | 8 | 800 | 0.0018 | 65 | X | COMPARATIVE EXAMPLE |
| 154 | 93 | R | 1.0 | 1000 | 8 | 800 | 0.0019 | 62 | X | COMPARATIVE EXAMPLE |

From Table 4, it can be understood that in each of the examples of the present invention, the increasing amount of nitrogen in the steel after the strain relief annealing is kept low, and a good value can be obtained regarding the motor core loss as well.

The invention claimed is:

1. A non-oriented electrical steel sheet, comprising a chemical composition represented by:

in mass %,

C: 0.0010% to 0.0050%;

Si: 2.5% to 4.0%;

Al: 0.0001% to 2.0%;

Mn: 0.1% to 3.0%;

P: 0.005% to 0.15%;

S: 0.0001% to 0.0030%;

Ti: 0.0005% to 0.0030%;

N: 0.0010% to 0.0030%;

Sn: 0.00% to 0.2%;

Sb: 0.00% to 0.2%;

Ni: 0.00% to 0.2%;

Cu: 0.00% to 0.2%;

Cr: 0.00% to 0.2%;

Ca: 0.0000% to 0.0025%;

REM: 0.0000% to 0.0050%; and the balance: Fe and impurities, wherein an average crystal grain diameter is 46 μm or less, and wherein when an average value of Mn concentrations in a range from a surface of a base iron to a position where a depth from the surface of the base iron is 2 μm is set to $[Mn_2]$, and an Mn concentration at a position where a depth from the surface of the base iron is 10 μm is set to $[Mn_{10}]$, the base iron satisfies the following expression 1, and wherein the [Mn10] substantially represents an average Mn concentration of the base iron, $$0.1 \leq [Mn_2]/[Mn_{10}] \leq 0.9 \quad \text{(Expression 1).}$$

2. The non-oriented electrical steel sheet according to claim 1, wherein the non-oriented electrical steel sheet contains one kind or more selected from a group consisting of:

Sn: 0.01% to 0.2%; and

Sb: 0.01% to 0.2%.

3. The non-oriented electrical steel sheet according to claim 1, wherein the non-oriented electrical steel sheet contains one kind or more selected from a group consisting of:

Ni: 0.01% to 0.2%;

Cu: 0.01% to 0.2%; and

Cr: 0.01% to 0.2%.

4. The non-oriented electrical steel sheet according to claim 1, wherein the non-oriented electrical steel sheet contains one kind or more selected from a group consisting of:

Ca: 0.0005% to 0.0025%; and

REM: 0.0005% to 0.0050%.

5. The non-oriented electrical steel sheet according to claim 1, wherein:

an insulating coating film is provided to the surface of the base iron;

an adhesion amount of the insulating coating film is not less than 400 $mg/m^2$ nor more than 1200 $mg/m^2$; and a divalent Fe content and a trivalent Fe content in the insulating coating film are not less than 10 $mg/m^2$ nor more than 250 $mg/m^2$ in total.

6. The non-oriented electrical steel sheet according to claim 1, wherein the $[Mn_{10}]$ substantially represents an average Mn concentration of the base iron, $$0.1 \leq [Mn_2]/[Mn_{10}] \leq 0.9 \quad \text{(Expression 1).}$$

7. A manufacturing method of a non-oriented electrical steel sheet, comprising:

performing hot rolling of a steel ingot to obtain a hot-rolled steel sheet;

performing hot-rolled sheet annealing of the hot-rolled steel sheet;

performing pickling after the hot-rolled sheet annealing;

performing cold rolling after the pickling to obtain a cold-rolled steel sheet; and performing finish annealing of the cold-rolled steel sheet to obtain the non-oriented electrical steel sheet, wherein:

the hot-rolled sheet annealing is performed by setting a dew point to not less than −40° C. nor more than 60° C., setting an annealing temperature to not less than 900° C. nor more than 1100° C., and setting a soaking time to not less than 1 second nor more than 300 seconds, while leaving a scale generated during the hot rolling;

an annealing temperature is set to less than 900° C. in the finish annealing; and the non-oriented electrical steel sheet comprises a chemical composition represented by:

in mass %,

C: 0.0010% to 0.0050%;

Si: 2.5% to 4.0%;

Al: 0.0001% to 2.0%;

Mn: 0.1% to 3.0%;

P: 0.005% to 0.15%;

S: 0.0001% to 0.0030%;

Ti: 0.0005% to 0.0030%;

N: 0.0010% to 0.0030%;

Sn: 0.00% to 0.2%;

Sb: 0.00% to 0.2%;

Ni: 0.00% to 0.2%;

Cu: 0.00% to 0.2%;

Cr: 0.00% to 0.2%;

Ca: 0.0000% to 0.0025%;

REM: 0.0000% to 0.0050%; and the balance: Fe and impurities, wherein an average crystal grain diameter is 46 μm or less, and wherein when an average value of Mn concentrations in a range from a surface of a base iron to a position where a depth from the surface of the base iron is 2 μm is set to $[Mn_2]$, a depth from the surface of the base iron is 5 μm is set to $[Mn_5]$, and an Mn concentration at a position where a depth from the surface of the base iron is 10 μm is set to $[Mn_{10}]$, the base iron after the pickling satisfies the following expressions, and wherein the $[Mn_{10}]$ substantially represents an average Mn concentration of the base iron, $$0.1 \leq [Mn_2]/[Mn_{10}] \leq 0.9 \quad \text{(Expression 1)}$$

$$0.1 \leq [Mn_5]/[Mn_{10}] \leq 0.9 \quad \text{(Expression 2).}$$

8. The manufacturing method of the non-oriented electrical steel sheet according to claim 6, further comprising after the finish annealing, forming an insulating coating film on the surface of the base iron.

9. The manufacturing method of the non-oriented electrical steel sheet according to claim 7, wherein the steel ingot contains one kind or more selected from a group consisting of:

Sn: 0.01% to 0.2%; and

Sb: 0.01% to 0.2%.

10. The manufacturing method of the non-oriented electrical steel sheet according to claim 7, wherein the steel ingot contains one kind or more selected from a group consisting of:

Ni: 0.01% to 0.2%;

Cu: 0.01% to 0.2%; and

Cr: 0.01% to 0.2%.

11. The manufacturing method of the non-oriented electrical steel sheet according to claim 7, wherein the steel ingot contains one kind or more selected from a group consisting of:

Ca: 0.0005% to 0.0025%; and

REM: 0.0005% to 0.0050%.

* * * * *